United States Patent [19]

de Groot

[11] 3,974,789

[45] Aug. 17, 1976

[54] FLOATING STRUCTURES INCLUDING HONEYCOMB CORES FORMED OF ELONGATE HEXAGONAL CELLS

[76] Inventor: Sebastian J. de Groot, Trans Canada Highway, R.R. No. 1, Cobble Hill, British Columbia, Canada, VOR ILO

[22] Filed: Aug. 5, 1974

[21] Appl. No.: 494,830

[52] U.S. Cl. ..... 114/.5 F; 9/8 R; 114/65 A; 114/74 T; 114/235 R

[51] Int. Cl.[2] ..... B63B 35/00; B63B 5/14

[58] Field of Search ..... 114/235 R, 235 A, 235 B, 114/65 R, 65 A, 74 R, 74 T, 74 A, .5 F, .5 T, .5 BD, 78, 206 R; 9/8 R

[56] References Cited

UNITED STATES PATENTS

| | | | |
|---|---|---|---|
| 1,759,644 | 5/1930 | Reed-Hill | 114/74 R |
| 1,885,889 | 11/1932 | Beam | 114/.5 F |
| 2,318,150 | 5/1943 | Foss | 114/235 A |
| 2,321,811 | 6/1943 | Harris | 114/65 A |
| 2,365,770 | 12/1944 | Nebolsine | 114/65 A |
| 2,645,114 | 7/1953 | Amirikian | 114/.5 F |
| 3,152,568 | 10/1964 | Mayer | 114/.5 F |
| 3,276,209 | 10/1966 | Mosdell | 114/.5 F |
| 3,833,035 | 9/1974 | Yee | 114/65 A |

FOREIGN PATENTS OR APPLICATIONS

| | | | |
|---|---|---|---|
| 131,640 | 9/1919 | United Kingdom | 114/65 A |

*Primary Examiner*—Duane A. Reger
*Assistant Examiner*—Stuart M. Goldstein
*Attorney, Agent, or Firm*—Christensen, O'Connor, Garrison & Havelka

[57] ABSTRACT

A tug vessel and a plurality of transport modules connected together in a chain, each including a honeycomb core formed of an array of hexagonal cells (preferably formed of reinforced concrete), are disclosed. The modules and, if desired, the tug vessel are adapted to transport liquids, gasses, semi-solids (e.g. grain) and the like in the cells. Universal joint mechanisms connect the tug vessel and the modules together in a manner which allows the tug vessel and modules to move essentially independently with respect to one another. The tug vessel includes a pair of oppositely rotating propellers, located amidships at the rear of sponsons. In addition, gimbled jet exhaust nozzels are used to control the attitude of the tug vessel. Emptying and filling of the hexagonal cells is accomplished via a conduit array which uses a central cell to act as communication chamber for surrounding cells. Cells located along the lateral sides of the overall array are used to house ballast water.

29 Claims, 47 Drawing Figures

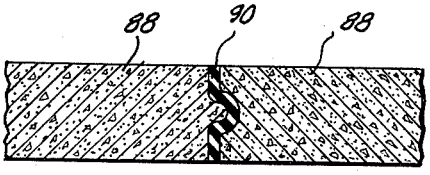
Fig. 16.
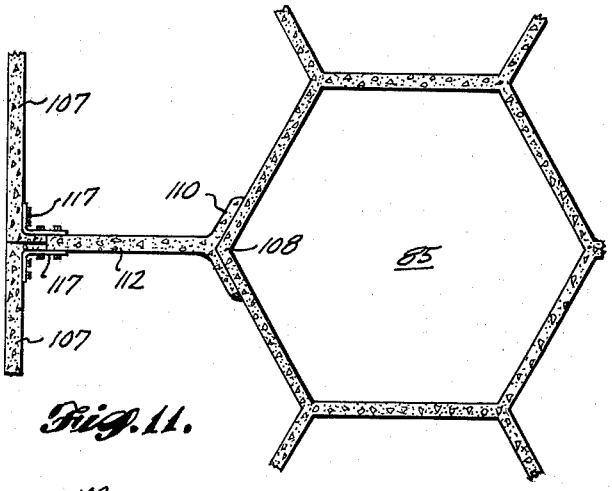
Fig. 11.
Fig. 10.
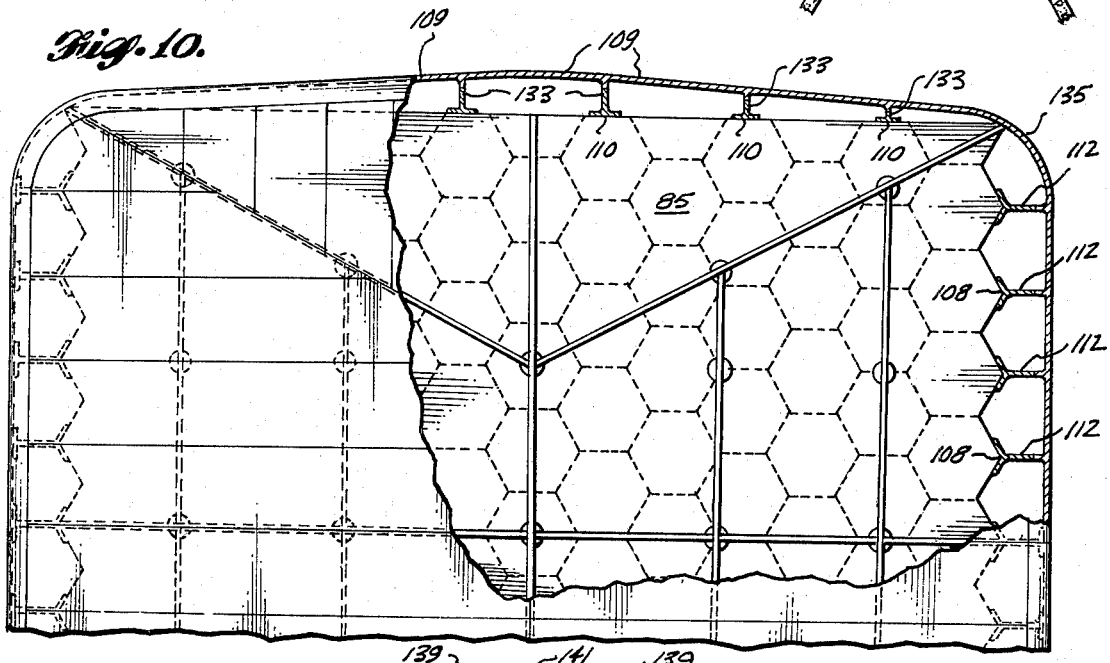
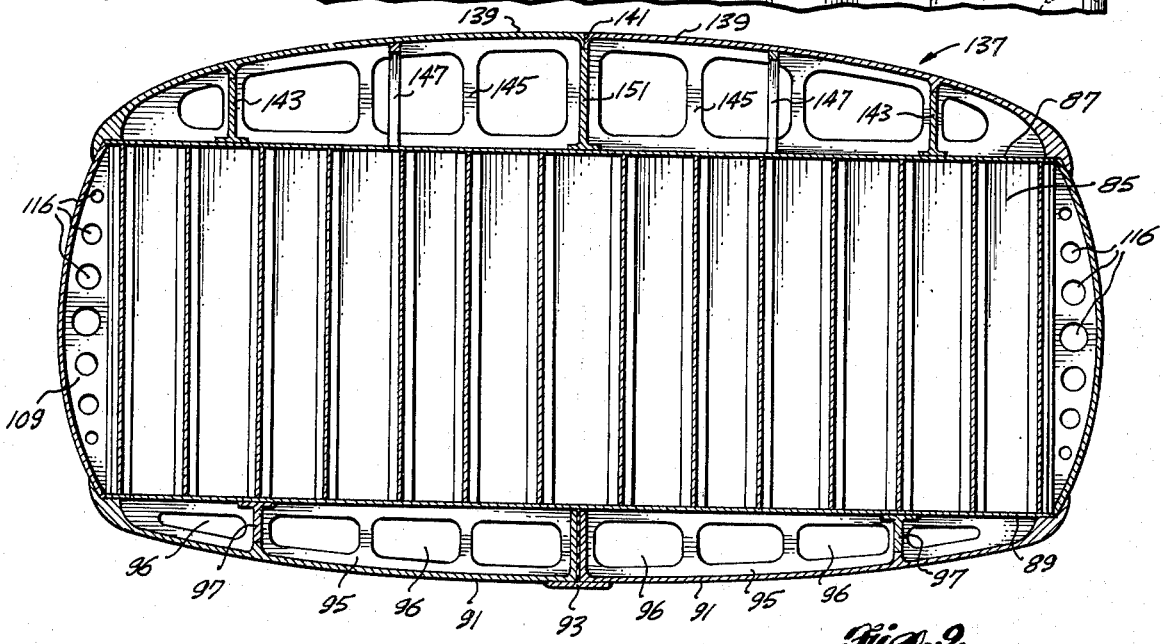
Fig. 9.

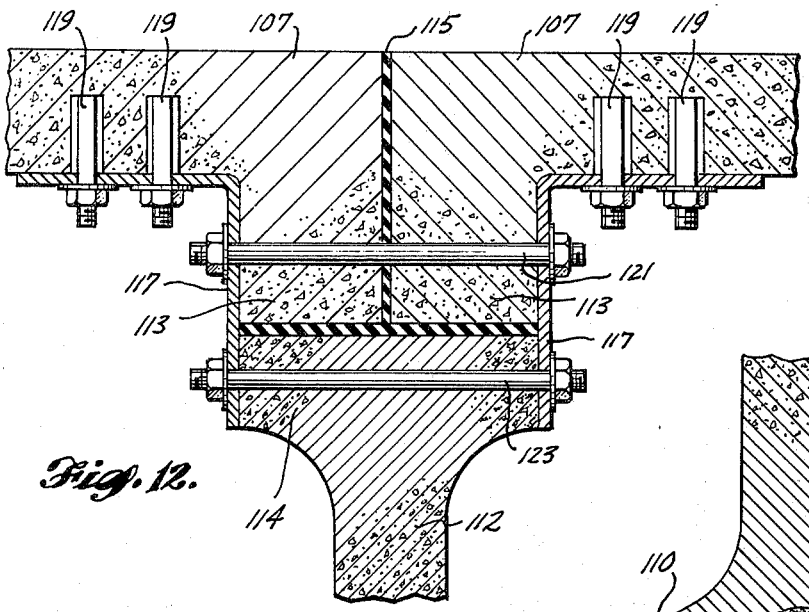
Fig. 12.
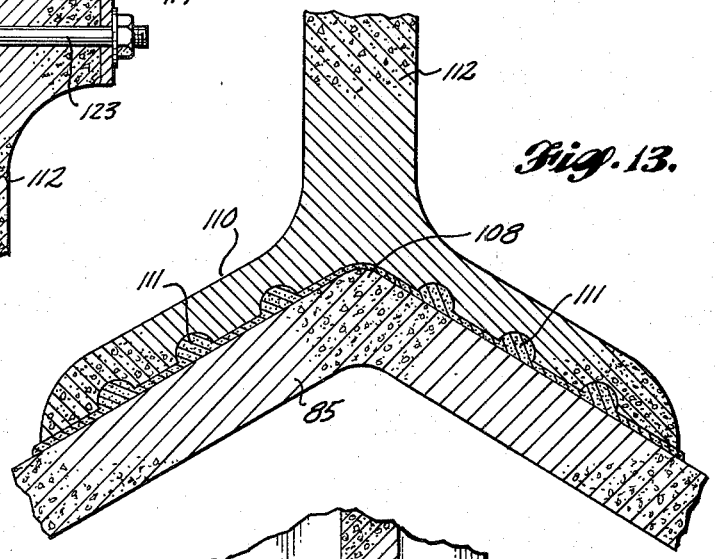
Fig. 13.
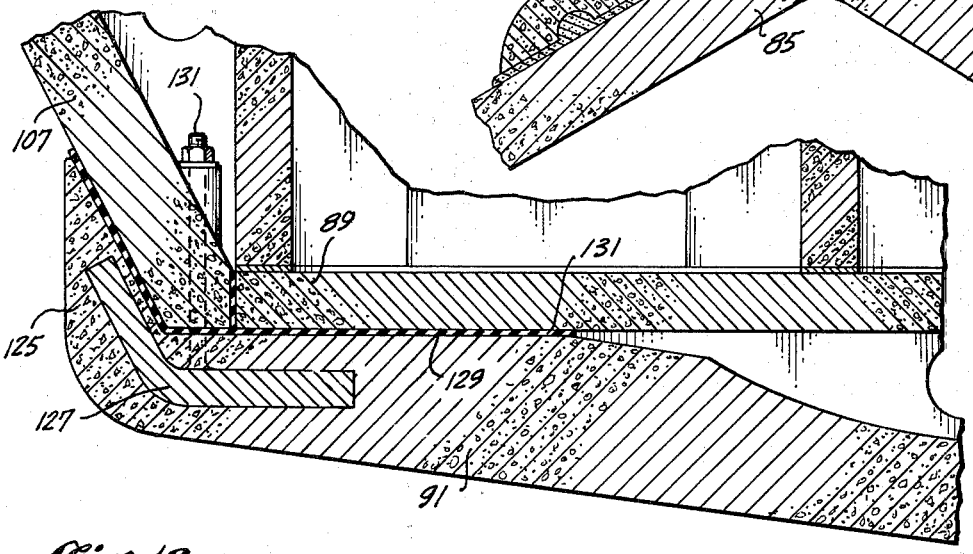
Fig. 17.
Fig. 18.
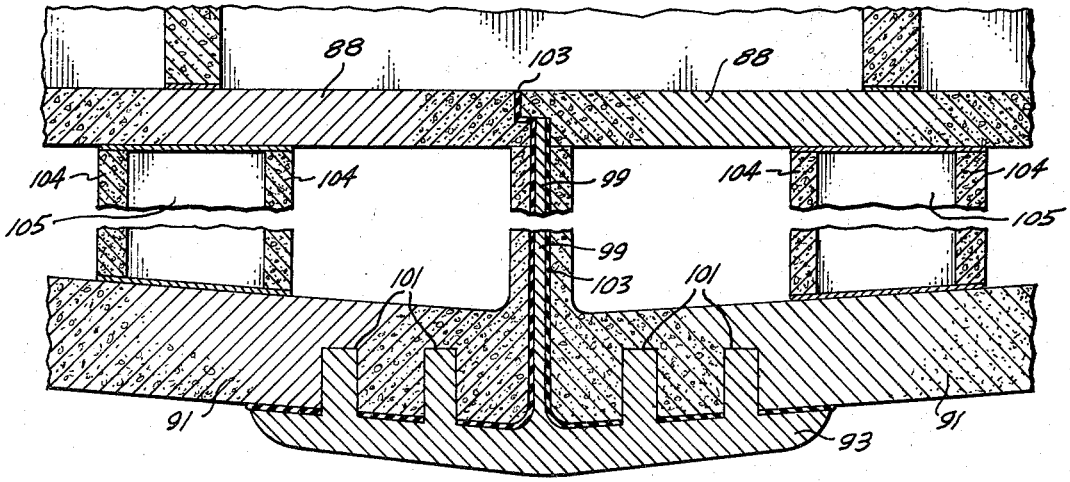

Fig. 33.
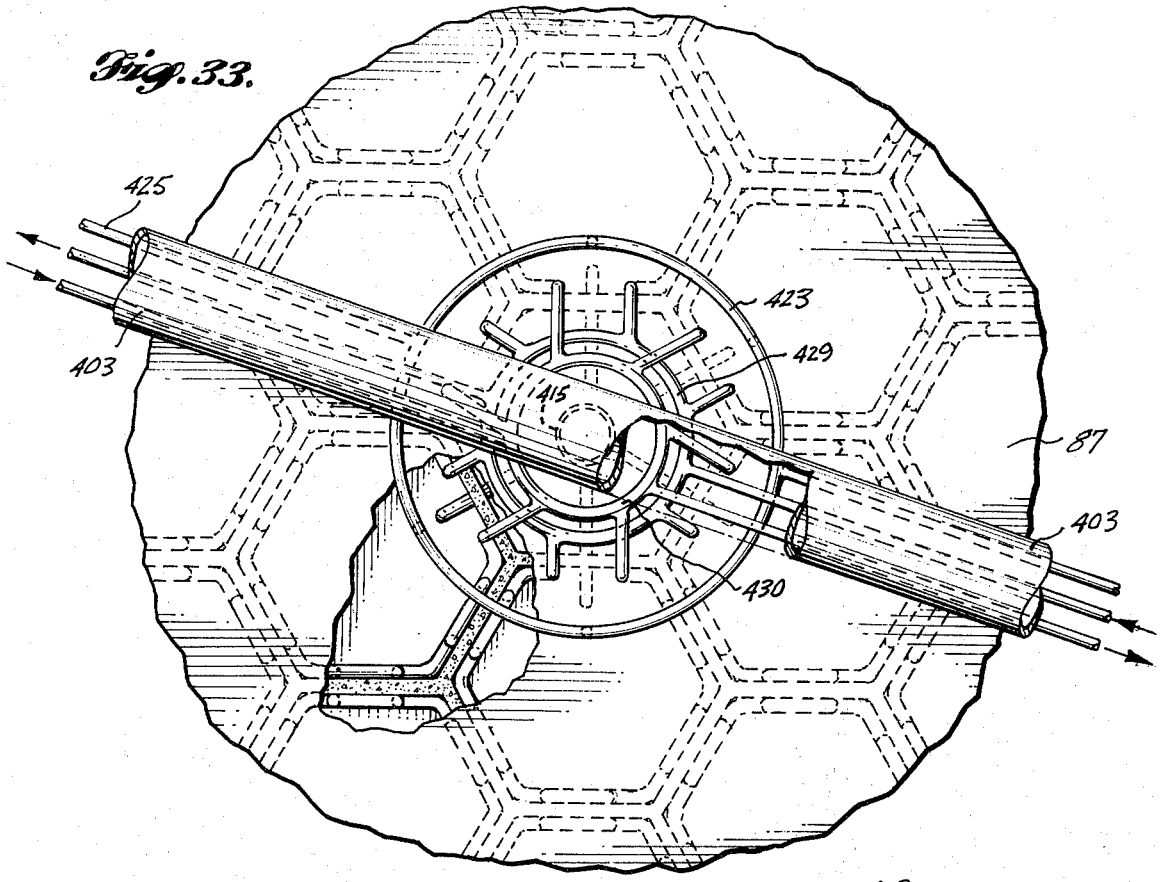
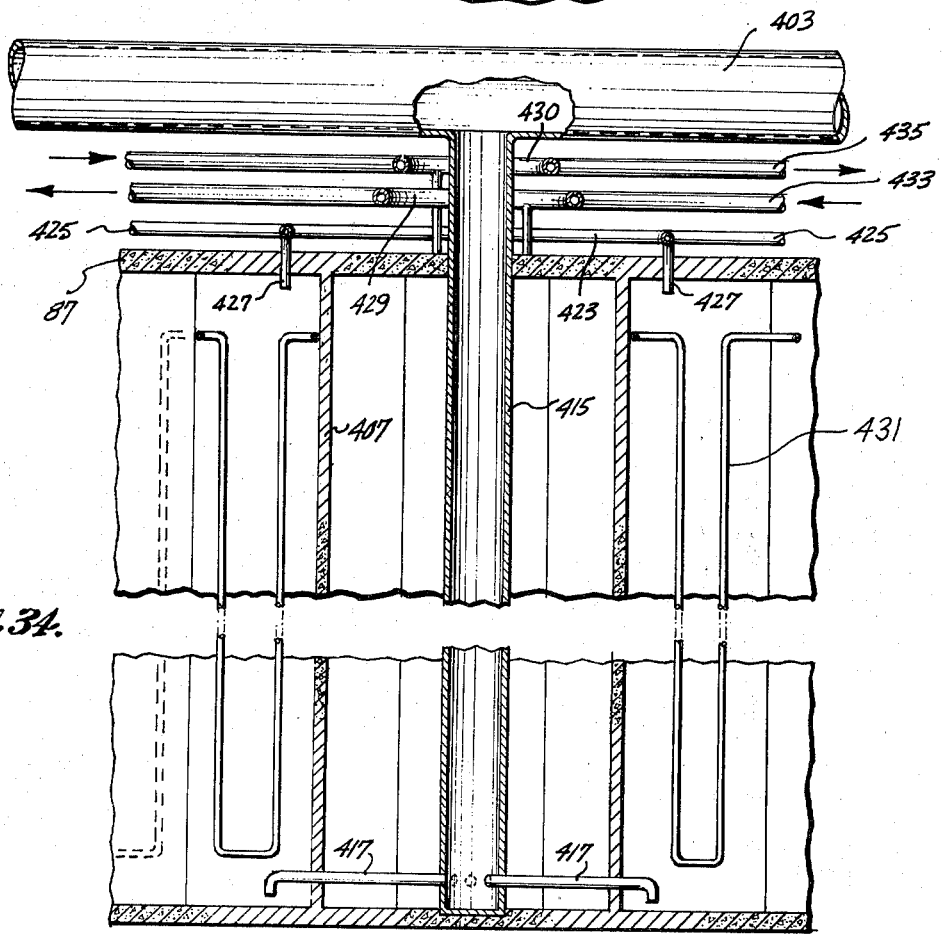
Fig. 34.

FLOATING STRUCTURES INCLUDING HONEYCOMB CORES FORMED OF ELONGATE HEXAGONAL CELLS

BACKGROUND OF THE INVENTION

This invention is directed to floating structures and, more particularly, to floating structures formed of concrete.

As will be better understood from the following description of the invention, the term "floating concrete structure(s)", as used herein, is to be given a broad construction. It encompasses movable structures suitable for use in transporting gasses, liquids, semi-solids and the like. In addition, it includes relatively stationary structures, such as docks, floating platforms, buoys and the like.

The use of concrete to form floating structures, such as boats, platforms and the like has been proposed in the past. However, for various reasons, the utilization of concrete for this purpose has not found widespread acceptance. On the other hand, concrete has a number of advantages which make it a desirable material for such uses. For examples, concrete is long lasting, and it "ages" well when left in sea water; that is, the structural strength of concrete improves with age, even when left permanently in sea water. Further, concrete is not readily attacked by acids and other corrosive materials contained, for example, in crude oil.

Therefore, it is a general object of this invention to provide new and improved concrete structures suitable for use in water.

On the negative side, in the past, it has been necessary for floating concrete structures to have relatively thick walls in order for such structures to have adequate strength. One of the major reasons for this requirement is inability of concrete to flex. More specifically, iron, wood and fiberglass have some flex or elasticity. Thus, when these materials are used to form the hull of a floating structure, such as a boat, some of the energy of the waves impinging on the side of the structure is absorbed by the structure flexing, as opposed to being absorbed by the strength of the structure per se. On the other hand, comparitively, concrete is relatively inelastic. Hence, in order for a concrete boat to have the overall structural strength of an iron or steel boat, the hull walls must be relatively thick. Because they are relatively thick, they are undesirably heavy. Because they are undesirably heavy a large portion of the energy driving the boat is required just to move the hull of the boat. Thus, the driving energy is not efficiently utilized to move the cargo carried by the boat. Obviously, it is desirable to provide a concrete boat that makes use of inexpensive concrete; yet does not possess these disadvantages of prior art concrete boats.

Therefore, it is a further object of this invention to provide a new and improved floating concrete structure suitable for use as a boat.

It is a further object of this invention to provide a new and improved concrete boat suitable for transporting materials at sea.

At the present time, relatively large ocean vessels are utilized to transport products, such as crude oil, liquified natural gas, and refined gasoline products (herein referred to as oil products) and the like, from the source of the product to the market for the product. Modern "oil" tankers are formed of iron hulls and have capacities up to 400,000 dead weight tons (d.w.t.), and tankers having capacities up to 800,000 d.w.t. have been proposed. There are two major problems associated with iron hull oil tankers of this nature. These problems are related to the oil tankers regardless of their size; however, they are magnified by the larger tankers presently plying the sea lanes, and those proposed. Specifically, these problems relate to pollution of the oceans and the surrounding shoreline.

Oil pollution generally occurs in either of two ways. The most publicized way occurs when a tanker is severely damaged by, for examples, collision with another boat or running aground. When such a tragic event occurs, an extremely large amount of oil rapidly enters the surrounding water, polluting it and, often, the adjacent shoreline.

The second major cause of sea pollution occurs when ballast water is pumped overboard prior to oil loading. Specifically, during the return from a market to a source of oil products, an oil tanker must carry ballast water. Ballast water is carried in the same compartments or container where oil is carried during the trip between the source of the oil products and the market. Thus, residual oil products become mixed with the ballast water, i.e., the ballast water becomes contaminated. When the tanker nears the source of the oil products, the ballast water is removed, often by pumping it overboard into the ocean. Because the ballast water is contaminated, it contaminates the surrounding ocean.

While proposals have been made to solve the foregoing problems, the proposed solutions are relatively expensive. For example, expensive electronic equipment has been developed to assist in the navigation of ships so that the possibility of collision and groundings can be reduced. In addition, expensive facilities have been provided to store ballast water on land and "clean" it prior to its being returned to the sea. In addition, ballast water cleaning systems have been included on board relatively large tankers to clean ballast water prior to its being pumped overboard. As indicated above, all of these solutions have one thing in common—they are expensive. Obviously it would be desirable to prevent large oil spills, and the initial contamination of the ballast water, whereby it would not have to be decontaminated.

Therefore, it is also an object of this invention to provide a floating structure for transporting oil products and the like that does not release an extremely large amount of such products into the surrounding sea even if severely damaged.

It is another object of this invention to provide a floating concrete structure suitable for carrying oil products and the like wherein ballast water is not comingled with oil products.

As alluded to above, the basic structure of the invention is not only useable to transport products at sea, it is also useable in other environments, herein generally referred to as floating platforms. In this regard, as used herein, the term "floating platform(s)" includes buoys, relatively large platforms such as floating bridges, helicopter landing pads, artificial deep sea ports, etc. In addition, the term floating platform(s) includes relatively small platforms suitable for use by marinas to form docks, floating gas stations and the like.

In the past, one of the major disadvantages of using concrete to form floating platforms has been the requirement that some form of floating support structure, such as logs, metal drums and the like, be utilized to support a pad made of concrete. Because the prior art requires subsidiary elements, such as metal drums, wood logs and the like, which deteriorate over relatively short periods of time, when kept in contact with sea water, the long lasting benefits of concrete are lost.

Therefore, it is another object of this invention to provide floating platforms essentially entirely formed of concrete.

It is yet a further object of this invention to provide concrete floating platforms suitable for use in the sea to form docks, floating bridges, buoys and other similar structures.

SUMMARY OF THE INVENTION

In accordance with principles of this invention, floating concrete structures formed of cells arrayed to create an enclosed honeycomb are disclosed. Preferably, initially, the cells are individually formed of reinforced concrete, and then connected together, even though they could be formed as a unitary structure, depending upon the environment of use. In either case, the walls separating the cells are relatively thin.

In accordance with further principles of this invention, the cells are hexagonal in cross section and are arrayed in horizontal layers with individual cells in each layer formed so as to interconnect with juxtaposed cells located in adjacent layers. As each layer is arrayed concrete is injected between the cells (by pouring or spraying) to connect them together. Further, side walls, and top and bottom walls are provided to enclose the resulting honeycomb core.

In accordance with further principles of this invention, floating concrete structures formed in accordance with the invention are utilized in modular form to create an ocean-going tanker vessel suitable for transporting oil products and the like. More specifically, a series of transport modules having cellular cores formed in accordance with the invention are chained together by universal joint mechanisms. In addition, one end of a chain of such modules is attached to a powered tug vessel. The universal joint mechanisms allow the transport modules to move with respect to one another and with respect to the tug vessel. Because "independent" movement is allowed, wave action energy is absorbed by "vessel" movement rather than by vessel strength per se, as would be required if the vessel were formed in a unitary manner.

In accordance with further principles of this invention, some of the cells are utilized to transport oil products and the like and others are utilized to transport ballast water, when necessary. Because the cells are entirely separate, no comingling of the oil products with the ballast water occurs. Moreover, the cellular construction allows extensive damage to occur to one or more modules (or the tug vessel) without extensive oil product spillage occurring. More specifically, if one of the modules or the tug vessel is involved in a collision, or runs aground, such that only a few of the cells are ruptured only the ruptured cells could disgorge all or part of their contents. The remaining cells contain their products. In this regard, in accordance with the invention, the cells adapted to transport the ballast water are located about the periphery of the cellular core. Thus, these cells are the ones most likely to be ruptured in the event of a collision. Hence, the material most likely to be disgorged is sea water having no contamination effect.

In accordance with other principles of this invention, the tug vessel includes a pair of propellers, one located on either side of the vessel at the rear of sponson-like members. Preferably, one propeller rotates in a clockwise direction and the other rotates in a counter-clockwise direction, one propeller being "right handed" and the other being "left handed", which propeller rotates in a particular direction being determined by whether the vessel is moving backwards or forwards. In addition, jet exhausts are directed rearwardly from the tug vessel via gimbled jet exhaust nozzles. The position of the exhaust nozzles controls the attitude of the tug vessel. Further, the prow of the tug vessel is rather short when compared with other vessels adapted to transport the same capacity of oil products as the tug vessel of the invention and its associated transport modules.

In accordance with further principles of this invention, the hexagonal cells are arrayed in a manner such that a series of such cells surround "central" cells. The central cells are coupled to a conduit system adapted to fill and empty the surrounding cells.

In accordance with yet other principles of this invention, the basic concrete hexagonal cellular core of the invention is utilized to form floating platforms, such as docks and movable sea platforms suitable for various uses. In these environments, the containers are maintained empty (essentially) and used to provide the buoyancy necessary for the structures to float. Because the cells are entirely enclosed, destruction of a portion of the cells, such as by a collision or the like, does not allow the overall structures to sink. The remaining undestroyed cells keep them afloat. It will be appreciated that because such structures are formed of concrete, electrical, water and other conduits can be precast in the interior of the structures during their formation.

In accordance with still other principles of this invention, the concrete hexagonal cellular core of the invention is utilized to form buoys and the like. It will be appreciated that because the buoys are formed of concrete, their lifetime is greatly enhanced when compared with standard buoys formed of metal drums and the like. In fact, concrete buoys formed in accordance with the invention actually improve in strength with age even though they are constantly exposed to sea water.

It will be appreciated from the foregoing summary that the invention basically comprises a concrete cellular core that floats. The structure is strong and cannot easily be destroyed to the point it will sink. The basic cellular core can be used to form boats suitable for transporting oil products and the like in a plurality of separated cells. Because the cells are separated, the product being transported is not mixed with ballast water transported in other cells whereby one of the primary disadvantages of oil tankers presently in use is overcome. Moreover, the invention is useful in forming floating platforms which may or may not be permanently located at some particular geographic position. Also the invention is useful in forming buoys and the like. In each case the benefits of concrete are retained while the prior art disadvantages associated with the use of concrete are overcome.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein:

FIG. 9 is a transverse cross-sectional view of the transport module illustrated in FIG. 8;

FIG. 10 is a partial top view, partially broken away, of the transport module illustrated in FIG. 8;

FIG. 11 is a fragmentary view illustrating the attachment of concrete side panels to a honeycomb core formed of hexagonal concrete cells in accordance with the invention;

FIG. 12 is an enlarged fragmentary view of a portion of FIG. 11;

FIG. 13 is an enlarged fragmentary view of another portion of FIG. 11;

FIG. 16 is an enlarged fragmentary view illustrating the junction between a pair of concrete panels utilized to form floors in the transport module illustrated in FIG. 8;

FIG. 17 is an enlarged fragmentary cross-sectional view of a bottom corner of the transport module illustrated in FIG. 8;

FIG. 18 is an enlarged fragmentary cross-sectional view of the keel of the transport module illustrated in FIG. 8;

FIG. 33 is a top view illustrating a central hexagonal cell and its six surrounding hexagonal cells, plus a portion of the cell filling and emptying conduit array of the invention;

FIG. 34 is an elevational view, partially in section, illustrating a portion of the cell filling and emptying conduit array of the invention;

DESCRIPTION OF THE PREFERRED EMBODIMENTS

Figure 1:
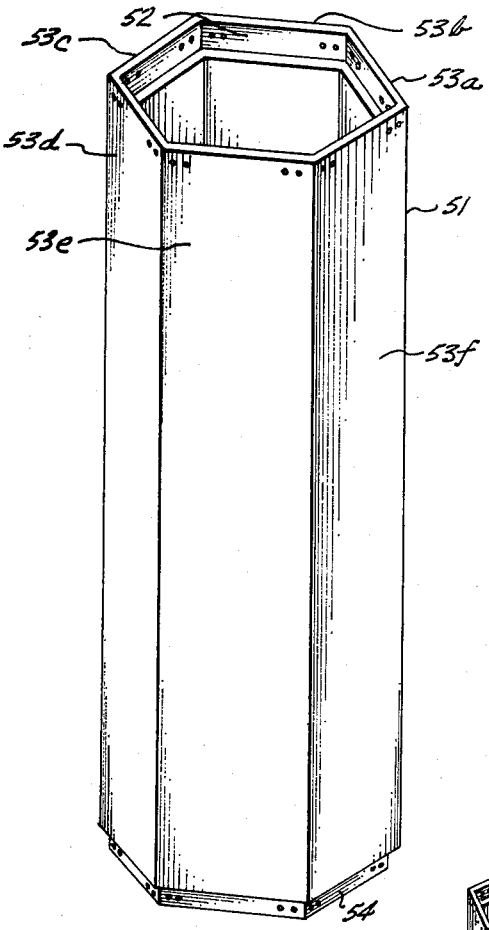
FIG. 1 is a perspective view of a single hexagonal concrete cell formed in accordance with the invention.

As will be better understood from the following description, the invention basically comprises a honeycomb core formed of concrete. The basic core is used to form various floating structures, the nature of the floating structures being determined by their intended use. By way of example, but not limitation, the floating structures may be movable and used to transport liquid or gaseous materials, such as oil products and the like. Alternatively, they may be relatively permanent and used to form buoys, docks, floating platforms and the like. While concrete structures formed in accordance with the invention do not need to be coated with any preservative, such as a marine paint, because concrete is not attacked by sea water, in some environments it may be desirable to coat the external surfaces of the resultant structures with an anti-fouling paint.

For purposes of clarity, various reinforcing materials, such as reinforcing iron rod, screens and the like have not been illustrated in the drawings, However, it is to be understood that the invention contemplates the inclusion of these elements where necessary and desirable. Moreover, it is to be understood that the concrete utilized is one suitable for use in sea water. In this regard, suitable light-weight concretes are well-known to those skilled in the concrete area, particularly the art of making precast, prestressed, thin walled curved panels and thin-walled conduits.

BASIC STRUCTURAL ARRANGEMENT

Figure 2:
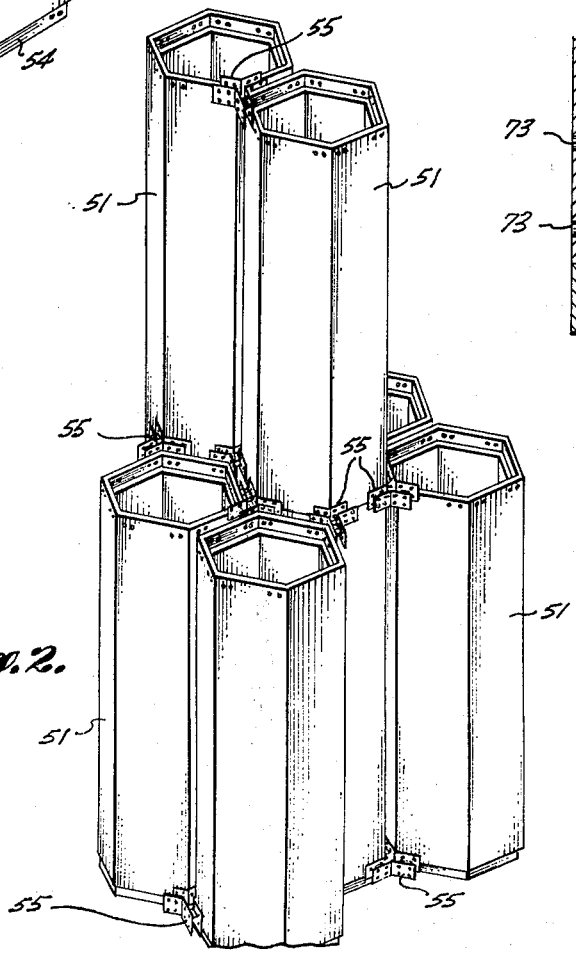
FIG. 2 is a perspective view of several hexagonal concrete cells formed in accordance with the invention assembled in accordance with the invention.

FIGS. 1–6 illustrate the honeycomb core of the invention and its manner of formation. Specifically, FIG. 1 illustrates a concrete cell 51 formed in accordance with the invention. The illustrated concrete cell 51 is a right hexagonal cylinder, i.e., it is a longitudinal object having six sides 53*a*, 53*b*, 53*c*, 53*d* and 53*e* and 53*f*, each having the same dimensions. Preferably, one end 52 of the cell 51 is internally undercut and the other end 54 externally undercut. The undercuts are formed in a manner such that the cells can be stacked, one on top of another, as illustrated in FIG. 2 and hereinafter described.

While the cells can take on a variety of sizes, a cell suitable for forming transport modules of the type hereinafter described has a wall height of 3 meters and a wall width of 2 meters. A suitable wall thickness lies in the area of ½ inch.

Figure 4:
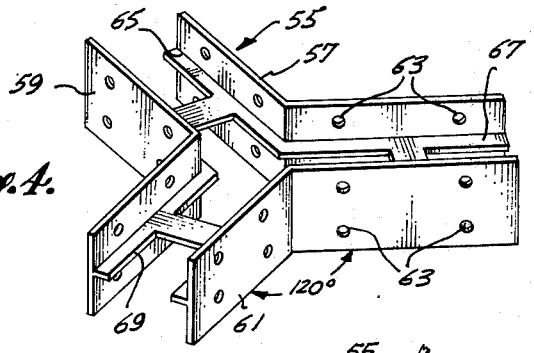
FIG. 4 is a perspective view of a spacer suitable for use in forming a horizontal layer of hexagonal concrete cells formed in accordance with the invention.
Figure 3:
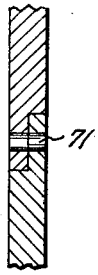
FIG. 3 is a partial sectional view illustrating the connection between a vertical pair of hexagonal concrete cells formed in accordance with the invention.
Figure 5:
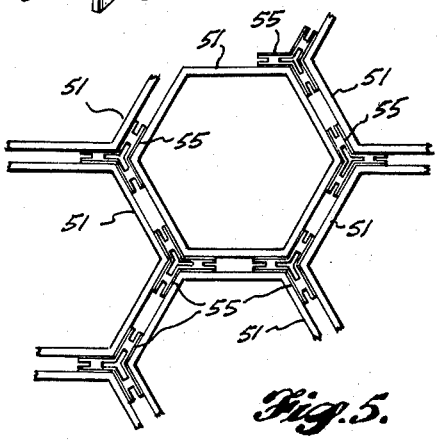
FIG. 5 is a top view of an array of a plurality of hexagonal concrete cells illustrating the location of spacers of the type illustrated in FIG. 4.
Figure 6:
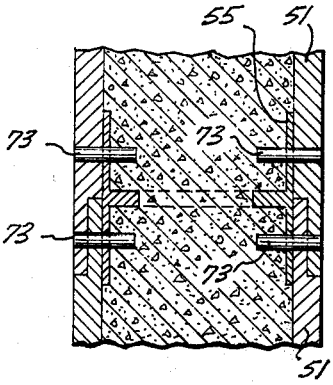
FIG. 6 is a partial cross-sectional view illustrating, in elevation, a spacer of the type illustrated in FIG. 4 located between the walls of a pair of adjacent hexagonal concrete cells.

FIG. 2 illustrates an array of a few hexagonal cells 51 of the type illustrated in FIG. 1. As will be better understood from the following description, a large number of such cells 51 are arrayed in horizontal layers, one stacked upon another, to form a final honeycomb core. Spacers 55, preferably of the type illustrated in FIG. 4, are used to connect adjacent cells together at adjacent corners as the honeycomb core is constructed. Further, as the core is constructed, concrete is injected (poured or sprayed) between the cells, after the insertion of suitable reinforcing materials. Preferably, first one horizontal layer is formed in this manner, i.e. the cells are arrayed, connected and concrete is injected between the cells. Thereafter, a second horizontal layer of cells is arrayed above the first utilizing the undercut interconnector mechanism previously described. As the second layer is formed the cells are also connected by spacers 55. Reinforcing is inserted between the second layer of cells and concrete is injected. Thereafter, the sequence is repeated until the entire structure is formed. The result is a honeycomb structure or core that defines an array of containers or cells each having a hexagonal cross section. A suitable spacing between cells, for the cell dimensions discussed above, is 1 inch or so.

The spacer 55 illustrated in FIG. 4 comprises three flanges 57, 59 and 61. Each flange is V-shaped and subtends an angle of 120°. Each leg of each flange includes four attachment holes 63. The flanges 57, 59 and 61 are arrayed so as to be equally spaced from one another and define an overall Y shape. Located between the flanges in a plane generally orthogonal to the faces of the flanges are H-shaped spacer members 65, 67 and 69 which may be unitarily formed together so as to also define a planar Y shape. Thus, the resultant structure, when viewed in a plane orthogonal to two adjacent legs of two V-shaped members, is H-shaped.

The holes 63 in the legs of the V-shaped flanges 57, 59 and 61 are formed so as to align with aligned holes 71 (FIG. 3) formed in both the inner and the outer undercut ends 52 and 54 of the hexagonal cells 51. More specifically, holes 71 are formed in the undercut ends of the cells so as to align with one another when two of the cells are stacked in the manner previously described. These holes 71 are also adapted to align with the holes 63 in the spacers 55. Suitable connecting elements 73 (FIG. 6), such as bolts, rivets and the like pass through the aligned holes to connect the stacked cells together and to connect the connectors 55 to the cells.

It will be appreciated at this point that the invention contemplates the production of a honeycomb array formed of hexagonal concrete cells. The interior of each cell is separated from every other cell, i.e., their is no intercellular communication. The resultant honeycomb structure is formed essentially entirely of reinforced concrete; yet it is extremely strong. Any individual cell can be ruptured or destroyed, without the strength of the overall system being greatly affected. In fact, a relatively large number of cells can be reptured or destroyed without the structural strength of the remaining cells being lost, even though overall structural strength may be somewhat decreased.

TRANSPORT VESSEL

Figure 7:
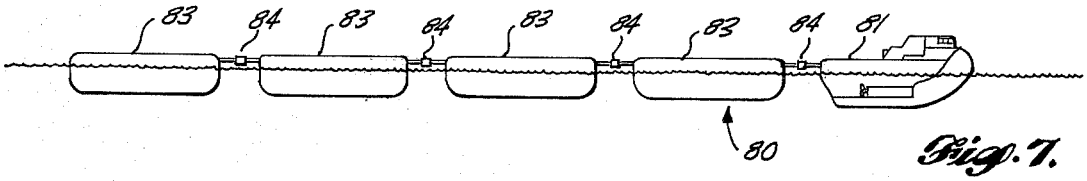
FIG. 7 gives a side view of a transport vessel formed in accordance with the invention.

FIG. 7 illustrates a transport vessel or boat 80 formed in accordance with the invention. The transport vessel 80 of the invention comprises a tug vessel 81 and a chain of transport modules 83. The transport vessel 80 is primarily adapted to transport oil products and the like. By oil products is meant crude oil, refined gasoline, kerosene, etc. and natural gas; by the like is meant other liquids and gases, plus semi-solids, e.g., grain.

In general, each of the transport modules 85 is connected via a universal joint connector or mechanism 84 to its adjacent module or modules, or the tug vessel 81, as the case may be. As will be better understood from the following description, this form of connection allowed the transport modules to move independently of each other, and of the tug vessel. If such independent movement were not allowed, a transport vessel formed of concrete would require considerably thicker walls than are the walls required by the present invention. As will be understood by those familiar with the technology of prior art concrete boats, the reason that thicker hull walls would be required of a unitary concrete vessel adapted to carry cargo of the size to be transported by the present invention relates to the inelasticity of concrete. More specifically, one of the primary reasons that wood, iron and the like have found widespread use in seagoing vessels has been because of their ability to elastically absorb the shock force created by constant wave action, without destruction. Concrete on the other hand is relatively inelastic. The inelasticity of concrete, in the past has required that boats formed thereof have relatively thick hull walls, at least when compared with wood, iron, etc. Thus, the weight-to-cargo ratio of such vessels has been relatively high. Because this ratio has been relatively high, the cost of moving a cargo has been prohibitive when compared with the cost of moving a similar cargo in an iron vessel, even considering the relatively short life of an iron vessel when compared to a concrete vessel.

Transport Module

Figure 8:
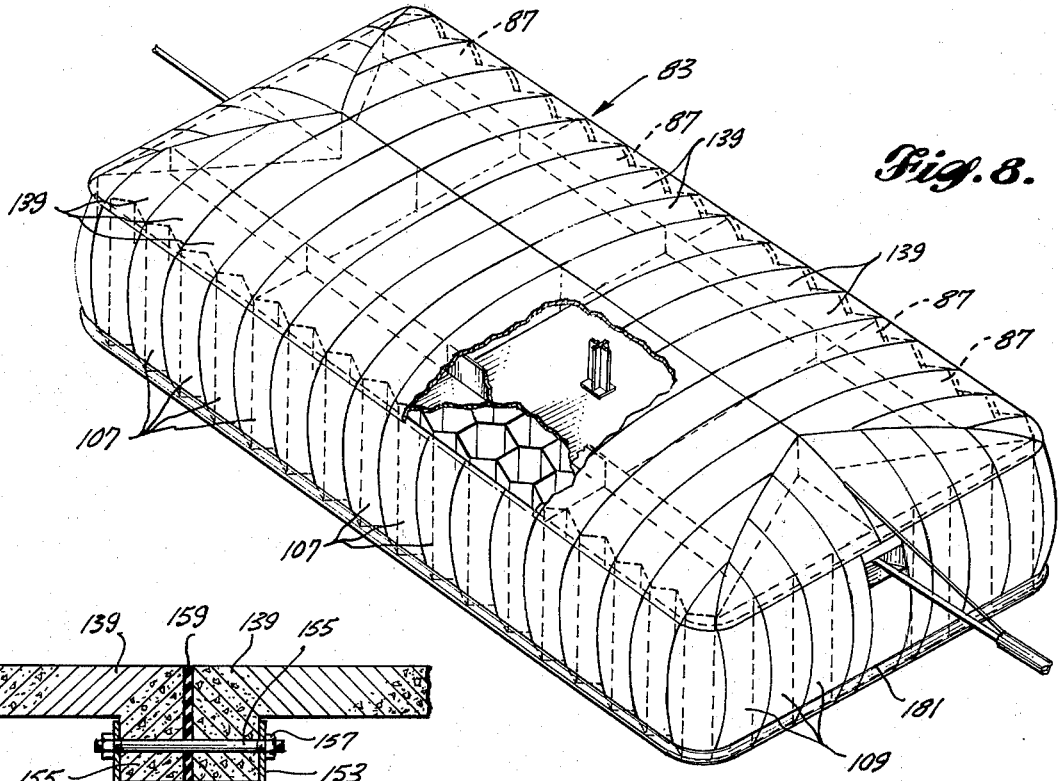
FIG. 8 is a perspective view, partially in section, of a transport module formed in accordance with the invention.

FIG. 8 is a perspective view, partially in section, illustrating a transport module 83 formed in accordance with the invention comprising a honeycomb core 85 formed of an array of cells of the type described above. While various numbers of cells can be utilized to form the honeycomb core 85 a suitable number is a 24 × 13 array, i.e., the core is 24 cells long and 13 cells wide, for cells having the thickness, height and width dimensions set forth above, a suitable number of horizontal layers of cells, each 3 meters high is five.

The honeycomb core 85 is enclosed by an upper floor 87 and a lower floor 89. Preferably, the upper and lower floors 87 and 89 are formed by a plurality of pre-cast concrete panels 88 that interlock in a tongue and groove manner separated by a layer of expansion material 90 (such as tar), as illustrated in FIG. 16. It should be noted that, although not shown in the drawings, the junctions between the plurality of precast panels 88 forming the upper and lower floors are not straight lines. Rather, preferably, the junctions are located above the discontinuous, transverse lines defined by selected cell walls. In this manner, contact between the expansion material 90 and the material transported in the cells is avoided. The surfaces of the upper and lower floors facing the core 85, although not shown in the drawings, preferably, include projections or indentations (as the case may be) which mate with the external or internal undercut ends 52 and 54 of the adjacent cells.

Located beneath the lower floor 89 are a series of spaced lower frames 95 located orthogonal to the longitudinal axis of the transport module. The frames 95 include aperture 96 which reduce their weight without unduly reducing their strength. Located beneath the spaced lower frames 95 are a series of curved bottom panels 91 which form a portion of the outer hull of the transport module 83. Preferably, the bottom panels 91 are preformed concrete panels. The panels 91 are attached together at mating edges and extend laterally from either side of a keel 93 running longitudinally along the bottom of each module 83. As illustrated, the panels 91 curve upwardly. Stringers 97 spaced from and lying parallel to the keel 93 extend between the floor panels 89 and the bottom panels 19, between (or through) the spaced lower frames 95. Thus, the spaced lower frames 95, the stringers 97, and the keel 93 form a framework that supports the lower floor 89 above the bottom panels 91.

The keel 93 and the manner in which it is connected are illustrated in FIG. 18. The keel 93 is preferably formed of iron and has a cross-sectional shape that defines an inverted T. Thus, the keel 93 includes a leg 99 which extends upwardly. The leg 99 extends into the lower floor 89. In addition, the keel 93 includes a plurality of projections 101 projecting upwardly from the "arms" of the keel. The projections 101 fit into suitable apertures formed in the bottom panels 91. A suitable expansion material, such as tar or the like 103, is located in the various joints between the keel and the associated floor and bottom panels to compensate for the slight thermal expansion difference that exists between concrete and iron, and to prevent cracking of the low elasticity concrete.

As an alternative to the apertured spaced lower frames 95 illustrated in FIG. 9 and described above, FIG. 18 illustrates an embodiment of the invention including no such frames. Rather stronger concrete stringers 104, running parallel to the longitudinal axis of the keel 93 and spaced therefrom, are included. Adjacent stringer members 104 are affixed to one another by spreaders 105, as desired, i.e., only some stringers are affixed in this manner.

Because of its nature, the honeycomb core 85 has cell side junctions 108 on two parallel vertical sides and cell sides 110 (no junctions) on the other two parallel vertical sides. For purposes of discussion the "junctions" 108 are illustrated as lying on either side of the transport module and the "sides" 110 are illustrated as lying to the front and rear.

Surrounding the honeycomb core 85 are a plurality of vertically arrayed curved panels. The side panels 107 are formed such that they line between a pair of adjacent cell side junctions 108. As illustrated in FIG. 11 side vertical ribs 112, also formed of concrete, extend outwardly from each cell side junction 108 to a joint between a pair of adjacent side panels 107. Suitable attachment means, illustrated schematically in FIG. 13 as a plurality of outwardly projecting nobs 111, attach the side vertical ribs 112 (which are Y-shaped on their inner ends) to the cell side junctions 108.

The outer edges 114, as illustrated in FIG. 12, of the side vertical ribs 112 are thicker than the "web" portion thereof and are attached to a joint between an associated pair of side panels 107. More specifically, the side panels 107 include outwardly projecting flanges 113 spaced from one another by a suitable expansion layer 115. Angle irons 117 lie in the corners formed between the flanges 113 and the main body of the side panels 107. The angle irons 117 extend toward the associated side vertical rib 112 so as to lie on either side of its thicker outer edge 114. Embedded bolts 119 project outwardly from the main body of the side panels 107 and are used to attach one face of the angle irons 117 to the side panels. Elongated panel bolts 121 pass through the flanges 113 and the adjacent angle irons 117. In addition, elongated rib bolts 123 pass through the thick end 114 of the associated rib 112, and the adjacent flanges of the angle irons 117. In this manner, adjacent side panels 107 are connected together and to an associated side vertical rib 112. Preferably, the side vertical ribs include, as illustrated in FIG. 9, as series of apertures 116 which allow liquids and the like to flow between the compartments defined by the side vertical ribs.

FIG. 17 illustrates the joint formed between the side panels 107, the bottom panels 91 and the lower floor panels 88. Specifically, the bottom panels 91 terminate at their outer ends in upwardly extending flanges 125. Elongated, V-shaped connectors 127 are embedded in the bottom panels 91 during their formation. Projecting upwardly from the V-shaped connectors 127, and formed in a unitary manner therewith, are bolts 131 adapted to pass through suitable reinforced vertical apertures formed in the lower edges of the side panels 107. In this manner, the side panels 107 are attached to the bottom panels 91. The formation of these panels is such that the side panels lie inside of the upwardly extending flanges 125. The lower floor panels 91 lie on a horizontal shelf 129 formed in the upper surface of the bottom panels 91 adjacent to the upwardly extending flanges 125. A suitable expansion material, such as tar 131, is located between the various joints formed between the side, bottom and lower floor panels.

FIG. 10 illustrates the attachment of end panels 109 to the ends of the honeycomb core 85. Specifically, a series of end vertical ribs 133 generally similar to the side vertical ribs 112 extend between the flat sides of the hexagonal cells and joints between associated end panels 109. The attachment to the end panels is made in generally the same manner as illustrated in FIG. 12 and described above. Attachment to the sides of the hexagonal cells may be made by bolts, or in any other suitable manner, as desired.

Suitable precast curved corners 135 extend around the corners of the honeycomb core and are connected to the nearest vertical ribs 112 and 133 associated with the sides and ends of the overall transport module, and their related side and end panels. Connection of the curved corners 135 to these elements is, preferably, accomplished in a manner similar to that illustrated in FIG. 12 and described above.

Located above the top floor 87 is a roof 137 formed to a plurality of precast curved roof panels 139. The roof panels 139 extend laterally outwardly and downwardly from a central longitudinal ridge line 141. The roof panels are locked together along adjacent edges in the manner hereinafter described. The panels 139 are supported by: (1) outer truses 143 (FIG. 9) lying parallel to the longitudinal axis of the transport module 83; (2) a series of center posts 151; and, a series of outer posts 147 lying between the outer truses and the center posts. In addition, upper frames 145 extend transversely across the upper floor and support the roof 137. Preferably, the upper frames are apertured to reduce weight without unduly reducing strength. The truses 143, the center and outer posts 151 and 147 and the upper frames all co-operate to support the roof panels above the upper floor 87 in a spaced manner. The thusly defined space houses a conduit system of the type hereinafter described.

Figure 14:
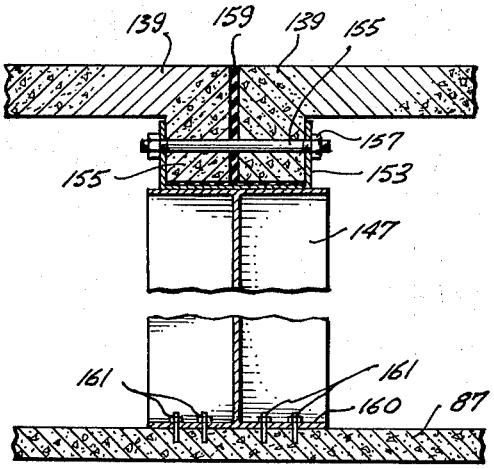
FIG. 14 is an enlarged fragmentary view illustrating one type of post suitable for supporting the roof of a transport module of the type illustrated in FIG. 8, and their manner of attachment.
Figure 15:
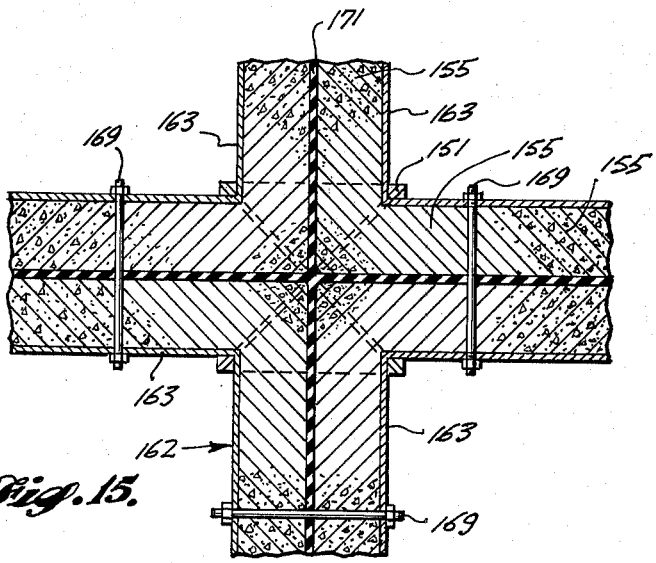
FIG. 15 is an enlarged fragmentary view also of a post suitable for use in supporting the roof of a transport module of the type illustrated in FIG. 8, at a different location.

All of the posts are, preferably, formed of iron and are X-shaped in cross section. FIG. 14 illustrates an outer post 146 and FIG. 15 illustrates a center post 151. The outer posts 147 support U-shaped members 153 at their upper ends. The U-shaped members are physically attached to the outer posts 147 by any suitable means, such as welding, for example. The outer posts are positioned such that the U-shaped members 153 surround the downwardly projecting flanges 155 located along the edge of a pair of adjacent roof panels 139. One or more elongated bolts 157 pass through the upwardly projecting flanges of the U-shaped members 153 and the downwardly projecting flanges 155 of the roof panels 139. A suitable expansion material 159 is located in the joint between the adjacent surfaces of the roof panels 139. The lower end of the outer posts are attached by orthogonal flanges 160 and bolts 161 to the upper floor 87.

FIG. 15 is a top view, with the body of the roof panels removed, illustrating a center post 151 supporting four roof panels 139 at their point of intersection. The downwardly projecting flanges 155 of the roof panels lie inside of a coupling mechanism 162 having four arms 163 which are generally U-shaped in cross section. The coupling element 162 is supported atop the X-shaped columns 151 and attached thereto be a weld, for example. A plurality of elongated bolts 169 pass through the various flanges of the coupling element 162 and the associated flanges 155 of the upper panels 139. In addition, a suitable expansion material 171 is located between the adjacent edges of the roof panels 139.

Universal Joint

Figure 19:
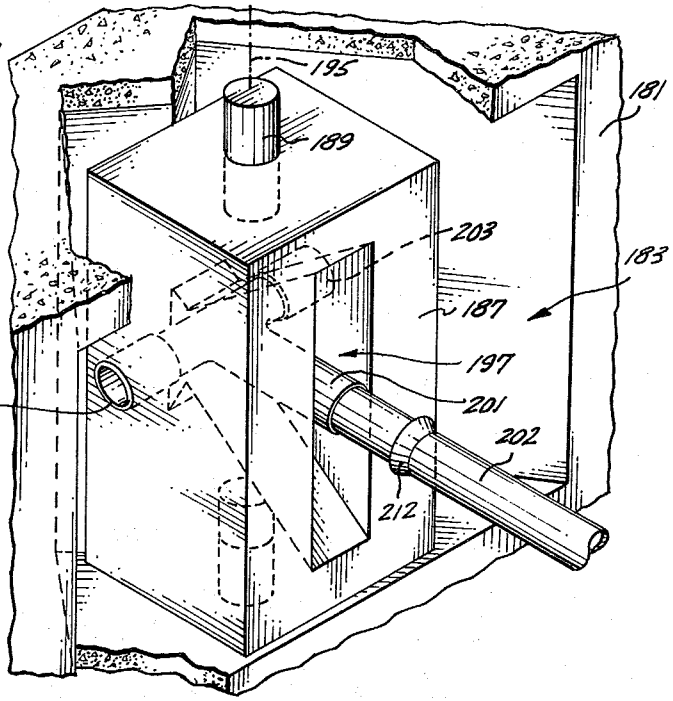
FIG. 19 is an isometric view of a universal joint mechanism formed in accordance with the invention.
Figure 21:
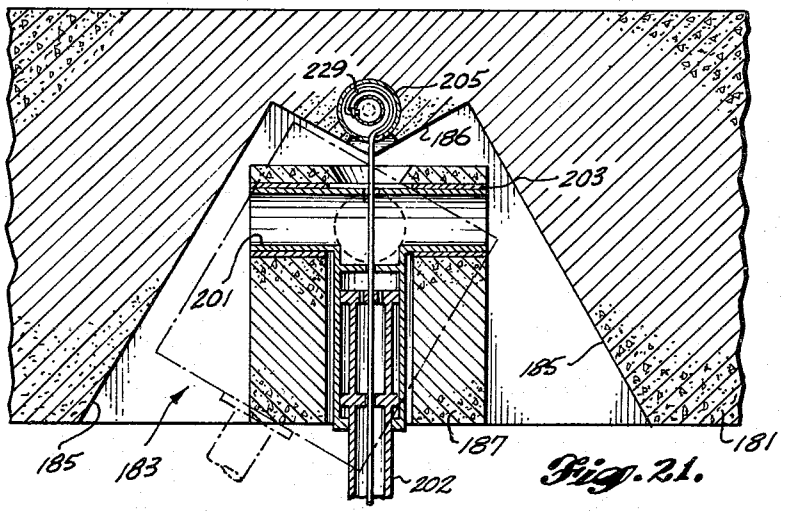
FIG. 21 is a cross-sectional top view of the universal joint mechanism illustrated in FIG. 19.
Figure 20:
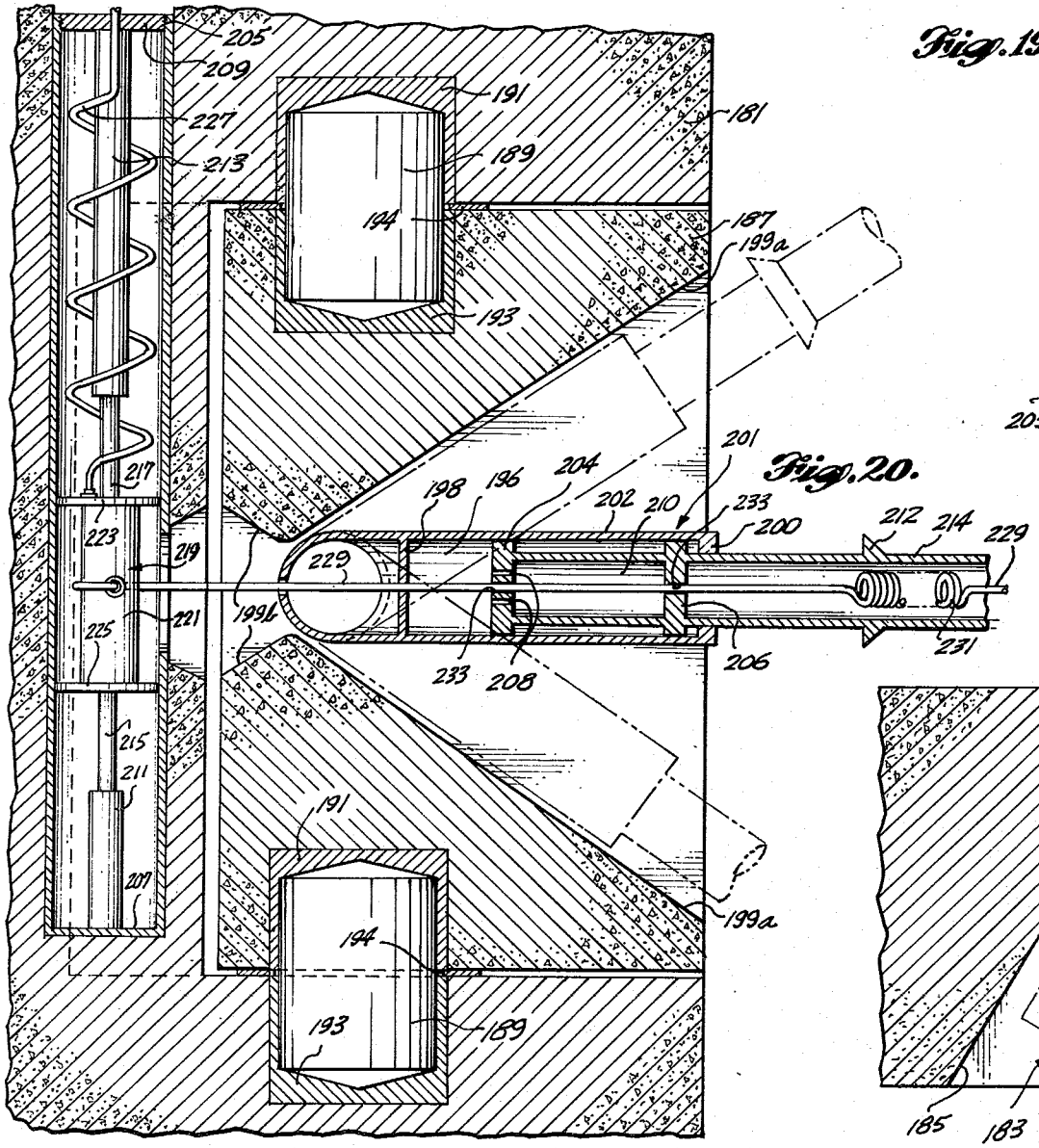
FIG. 20 is a cross-sectional side elevation of the universal joint mechanism illustrated in FIG. 19.

FIGS. 19–21 illustrate a universal joint forming part of the universal joint connector mechanism 84 connecting the transport modules 83 together, or to the tub vessel 81. At this point it should be noted that while only a single universal joint is included on either end of the transport module shown in FIG. 8, a plurality of such mechanisms could be included on either end. More specifically, as will be better understood from the following description, because the universal joints allow independent movements along a plurality of axes, two, three or more of such joints and their associated connector mechanisms could be utilized to couple a pair of transport modules together. The number will, of course, depend upon the coupling strength desired in a particular structural embodiment of the invention.

The universal joint (or joints) is (are) mounted in a special end panel (or panels) 181 (FIG. 8). As illustrated in FIG. 19, the special end panel, in the region of the universal joint, is relatively thick and includes an aperture 183. The aperture 183, when viewed in a horizontal plane, is W-shaped. Thus, the aperture defines a pair of outwardly diverging legs 185 and a central pointed region 186. Mounted in the aperture 183 is a concrete block 187. The block 187 is a right parallelepiped and extends essentially entirely from the top to the bottom of the aperture 183 between the diverging legs 185. The block 187 is pinned at its upper and lower surfaces to the panel 181 by a pair of vertical pins 189. The vertical pins 189 may be mounted in suitable outer bearings 191 mounted in apertures in the panel 181, and inner bearing 193 mounted in apertures in the block 187. In addition, spacers 194 may be located between the block 187 and the panel 181 about the pins 189. In this manner, the block 187 is pinned to the panel 181 so as to be rotatable about a vertical axis 195, between the legs 185 of the aperture 183. As illustrated the vertical axis 195 is equally spaced from the legs 185 and slightly outwardly from the tip of the central pointed region 186 defining the W-shaped aperture 183.

A vertical slot 197 best seen in FIG. 19 is formed in the block 187. When viewed in a vertical plane, the vertical slot 187 (FIG. 20) includes a pair of outwardly diverging, relatively long, legs **199*a* and a pair of inwardly diverging, relatively short, legs 199*b* which joint together by curved regions. Thus, the vertical slot 197, when viewed in cross section, is defined by a pair of opposed V's having legs that diverge outwardly in opposite directions, one "V" being relatively long and the other being relatively short. The slot 197 runs the entire distance between two parallel faces of the block 187.**

Mounted in the slot 197 is a T-shaped element 201 formed of two intersecting cylinders. The arms of the T-shaped element 201 are mounted in a pair of bearings 203 housed within the block 187 on either side of the slot 197. The bearings 203 lie along a common axis lying at right angles to the slot 197. The axis is equally spaced between the outwardly diverging, relatively long, legs 199*a* in front of the point where those legs meet the inwardly diverging, relatively short, legs 199*b*. The leg 202 of the T-shaped element 201 is formed so as to lie in the slot 197 between the outwardly diverging, relatively long, legs 199*a*. The leg 202, due to the diverging nature of the slot 197 is, thus, free to rotate vertically up and down.

It will be appreciated from the description thus far that the block 187 is free to rotate horizontally back and forth to a limited degree, and the T-shaped element is free to rotate vertically up and down to a limited degree. Thus, the described structure allows movement about two orthogonal axes, one generally vertical and the other generally horizontal.

A portion of the leg 202 of the T-shaped element 201 forms the housing of a hydraulic cylinder. More specifically, the leg 202 defines a first chamber 196 enclosed at one end by an inner wall 198 (located near the arms of the T-shaped element 201), and enclosed at the other end by an inwardly projecting flange 200 located at the outer tip of leg.

One end of a cylindrical coupling shaft 214 passes through the cylindrical aperture formed in the flange 200. The inner end of the coupling shaft 214 defines a second chamber 210 enclosed by a pair of walls 204 and 206, one located at the tip of the coupling shaft, and the other spaced from the tip. The pair of walls 204 and 206 extend both inwardly to define the chamber 210, and outwardly so as to ride on the inner surface of the first chamber 196. Fluid orfices 208 extend through the wall 204 located at the tip of the coupling shaft 201 to provide communication between the first and second chambers 196 and 210. Fluid (such as oil or hydraulic fluid) is housed in the two chambers and acts as a shock absorbing medium. A cylindrical stop 212 surrounds the coupling shaft 214 and limits its "inward" movement with respect to the leg 202 of the T-shaped element 201.

As will be better understood from the following description, the coupling shaft 214 is mated at its other tip to the coupling shaft of another transport module. Because the hydraulic cylinders allow the coupling shafts to move inwardly and outwardly with respect to their associated transport modules, obviously, the module spacing can vary.

As will be better understood from the following description of the connector mechanism adapted to connect a pair of coupling shafts, that mechanism requires a hydraulic line. The hydraulic line must pass through one of the universal joints without damage and without inhibiting the operation of the joint. FIGS. 20 and 21 illustrate a mechanism for accomplishing this result. The mechanism comprises a cylindrical housing 205 mounted in the pointed region 187 of the W-shaped aperture and lying about a vertical axis. The bottom 207 of the cylindrical housing 205 is unitary with the walls thereof and the top is formed by a cover 209. The cover 209 may be threaded into the top of the cylindrical housing 205, if desired.

Projecting vertically upwardly from the bottom 207 is a lower elongated bearing and support member 211, and projecting downwardly from the top 209 is an upper elongated bearing and support member 213. Aligned shafts 215 and 217 extend outwardly, toward one another, from the elongated bearing and support members 211 and 213. The shafts 215 and 217 are spaced from one another and affixed to the ends of a spool 219. The spool 219 includes a drum shaped mid-section 221 and end flanges 223 and 225. The shafts are attached to the end flanges. A loosely coiled primary hydraulic conduit 227 passes through a suitable aperture in the cover plate 209 and extends to the upper end flange 223 of the spool 219, about the upper elongated bearing and support member 213 and its associated shaft.

Attached to the center of the drum shaped mid-section 221 of the spool 219, and extending arcuately around a portion thereof as best illustrated in FIG. 21, is a secondary hydraulic conduit 229. The secondary hydraulic conduit is aligned with the axis of rotation of the T-shaped element and extends outwardly, through suitable apertures formed in the cylindrical housing, the pointed region 186 and the Tk-shaped element 201. The secondary hydraulic conduit extends through suitable apertures formed in the various walls defining the chambers of the hydraulic cylinder in a manner such that is generally co-axial with the longitudinal axis of the coupling shaft 202. Formed in the secondary hydraulic conduit 229 is an expansion and contraction coil 231 which prevents the conduit from breaking as the elements of the hydraulic cylinder move with respect to one another in the manner described above.

Connector Mechanism

Figure 23:
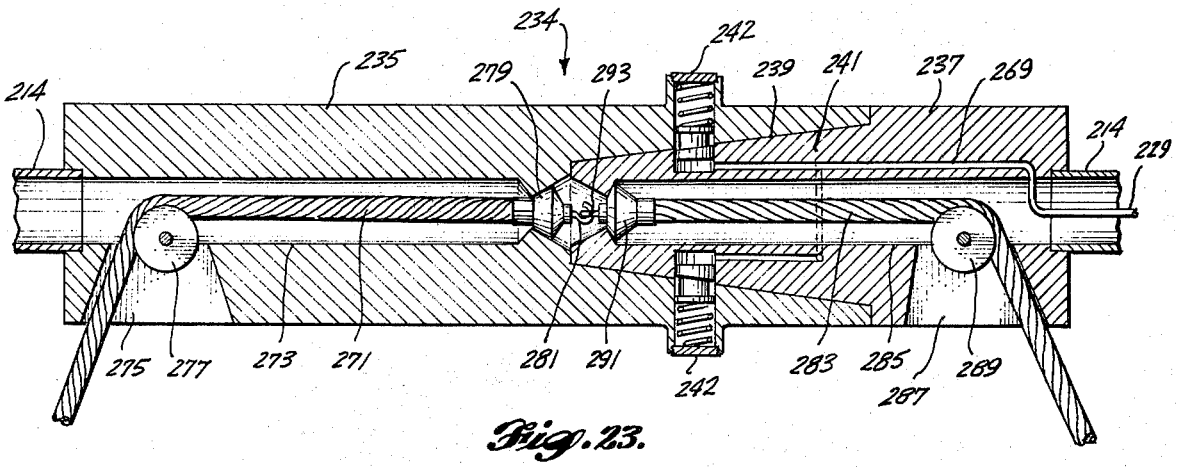
FIG. 23 is a cross-sectional view along line 23-23 of FIG. 22.
Figure 22:
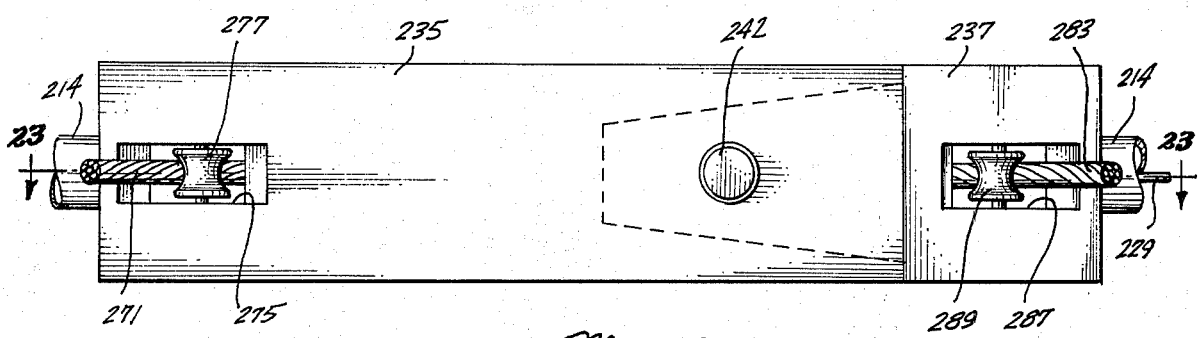
FIG. 22 is a top view of a coupling mechanism suitable for coupling two transport modules together, or coupling a transport module to a tug vessel.
Figure 24:
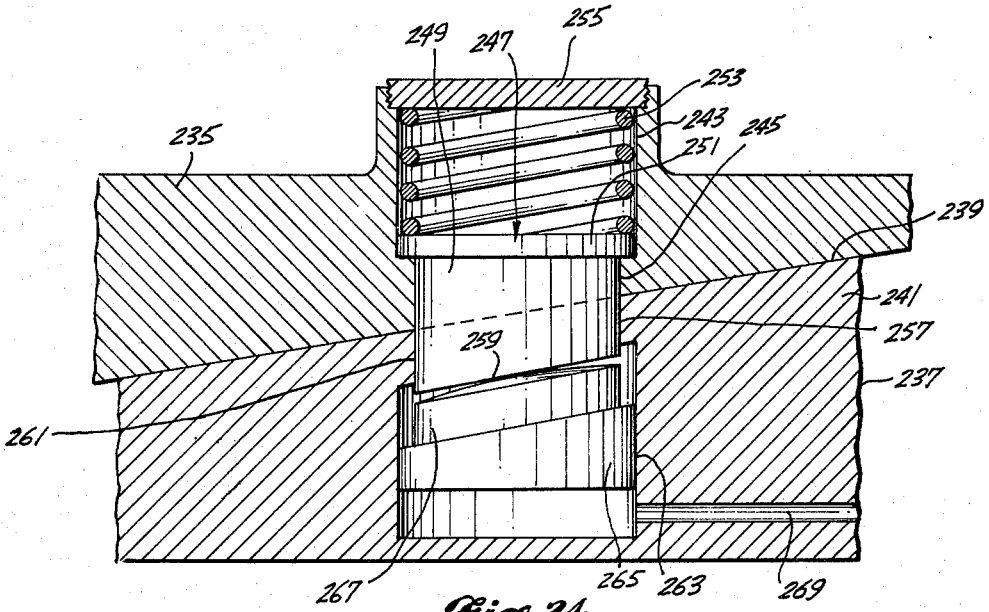
FIG. 24 is an enlarged cross-sectional view illustrating the coupling used in the coupling mechanism illustrated in FIGS. 22 and 23.

FIGS. 22–24 illustrate a connector mechanism 234 suitable for coupling a pair of coupling shafts 214, extending outwardly from a pair of adjacent transport modules, together. The connector mechanism 234 comprises a female coupling member 235 affixed to the outer end of one of said coupling shafts and a male coupling member 237 affixed to the outer end of the other of said coupling shafts. The female coupling member 235 defines a truncated pyramidal aperture 239 and the male coupling member 237 terminates in a mating truncted pyramidal shaped projection 241. When coupling is accomplished, the male projecton 241 lies in the female aperture 239.

The male and female members are locked together by a pair of connectors 242. The connectors 242 are best illustrated in FIG. 24 and comprise cylindrical vertical apertures, one being formed in the female member and the other being formed in the male member for each connector 242. Associated cylindrical vertical apertures are aligned when the male projection 241 lies in the female aperture 239. The cylindrical vertical aperture in the female member includes an enlarged region 243 lying outward of a contiguous smaller region 245 that houses a movable connector element 247. The movable connector element 247 includes a main cylindrical body 249 which lies in the smaller region 245 and a cylindrical outwardly extending flange 251 which lies in the enlarged region 243. A coil spring 253 also lies in the enlarged region 243. One end of the coil spring presses against and enclosing cover plate 255 and the other end presses against the adjacent surface of the connector element 247. Thus, the connector element 247 is pressed toward the interior of the female aperture 239. The connector element has an inclined outer surface 259 corresponding to the incline of the adjacent pyramidal face of the female aperture 239.

The cylindrical vertical aperture in the male member 237 also includes an enlarged region 263 and a smaller region 261. The smaller region 261 is generally the same diameter as is the diameter of the smaller region 245 of the cylindrical vertical aperture in the female member. A plunger element 265 lies in the enlarged region 263 and includes an upwardly projecting cylindrical portion 267 having a semispherical outer surface. The diameter of the cylindrical portion 267 is substantially the same as the diameter of the smaller cylindrical regions 245 and 251. A fluid flow conduit 269 formed in the male member 237 runs between the enlarged region and the secondary hydraulic conduit 229.

In operation, during module decoupling, pressure transmitted by a hydraulic fliud housed in the hydraulic conduits and the enlarged region 263 causes the plunger element 265 to move outwardly. This action causes the connector element 247 to move and compress the coil spring 263. When the hydraulic pressure has reached a suitable level, the inclined surface 259 of the coupling element 247 reaches a position where it is flush with the inclined surface 239 of the adjacent face of the female aperture 239. When this position is reached, the male and female members are readily moved apart.

The inclined surface 259 of the connector element 247 is formed such that pressure caused by drawing a set of male and female members together in the the manner hereinafter described is adequate to cause coupling. More specifically, during coupling the inclined surface of the connector element 247 rides on the associated inclined surface of the male projection 241 causing compression of the coil spring 247. When the cylindrical vertical apertures become aligned, the connector element 247 is pressed by the coil spring into the smaller region 257 formed in the male projection 241.

The male and female member 235 and 237 are brought together for coupling by a pair of ropes, one associated with each member. The rope 271 associated with the female member passes through a central aperture 273 and a transverse aperture 275, both formed in the female member. Located at the point where the apertures intersect is a pulley 277. The inner end of the female rope 271 terminates in a coupler 279 having a hook shaped end 281.

The rope 283 associated with the male member also passes through a cylindrical aperture 285 and a transverse aperture 287, both formed in the male member. Again, a pulley 289 is mounted at the point where the apertures intersect. The male rope 285 terminates in a coupler 291 having ring-shaped end 293. The ring-shaped end 293 and the hook-shaped end 281 are formed in a manner such that they can be joined together.

In operation, assuming the transport modules are separated, the male and female ropes are extended by any suitable means, and joined using the hook-shaped and the ring-shaped ends. The ropes are then withdrawn. As they are withdrawn, the male and female coupling elements 235 and 237 are brought together in correct general alignment, final alignment being determined by the pyramidal shapes of the female aperture 239 and the male projection 241. When the male projection becomes fully embedded within the female aperture final connection occurs in the manner previously described.

Wave Action

Figure 25:
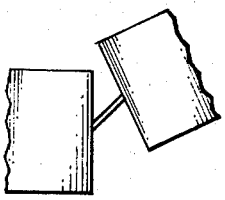
FIG. 25 is a top view of two transport modules illustrating the operation of a universal joint mechanism formed in accordance with the invention.
Figure 26:
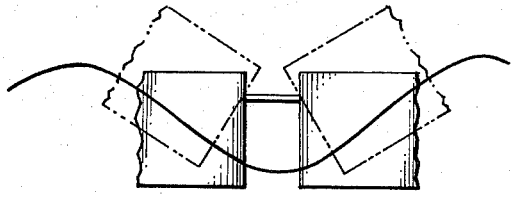
FIG. 26 is a side view of two transport modules illustrating the operation of a universal joint mechanism formed in accordance with the invention.
Figure 27:
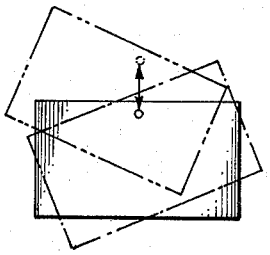
FIG. 27 is an end view of a transport module illustrating the operation of a universal joint mechanism formed in accordance with the invention.

FIGS. 25–27 illustrate, schematically, the movement of one transport module with respect to another transport module in a manner that uses relative module movement to absorb wave forces, as opposed to the structural absorbtion of such forces. FIG. 25 is a top view of a pair of transport modules and illustrates that the modules can independently move back and forth with respect to one another along the longitudinal axis generally defined by a chain of modules. Such movement is allowed because the blocks 187 are rotatable back and forth about generally vertical axes. FIG. 26 illustrates that the modules can move up and down with respect to one another, i.e., one module may be moving upwardly in accordance with wave action while another is moving downwardly. Such movement is allowed because the T-shaped members 201 are rotatable upwardly and downwardly about generally horizontal axes. FIG. 27 illustrates that the transport modules can also rotate about the longitudinal axes defined by the coupling shafts while moving in other directions, illustrated as up and down. Such rotational movement is allowed because the coupling shafts 202 are rotatably mounted in the legs of the T-shaped elements 201. Further, as previously indicated, the modules can move back and forth with respect to one another. Such movement is allowed by the "shock absorber" hydraulic mechanism formed by the leg of the T-shaped members and the associated ends of the coupling shafts 202. If desired, the last module in the chain may include a driven propeller to "stretch" the chain against the driving force created by the tug vessel.

Tug Vessel

Figure 28:
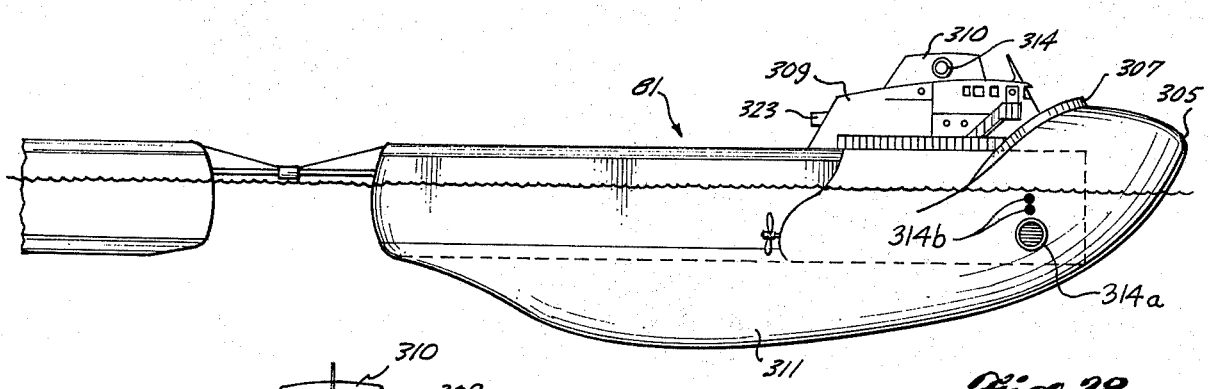
FIG. 28 is a side view of a tug vessel formed in accordance with the invention.
Figure 29:
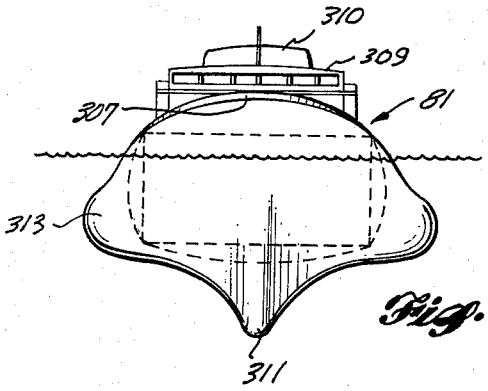
FIG. 29 is a front view of the tug vessel illustrated in FIG. 28.
Figure 30:
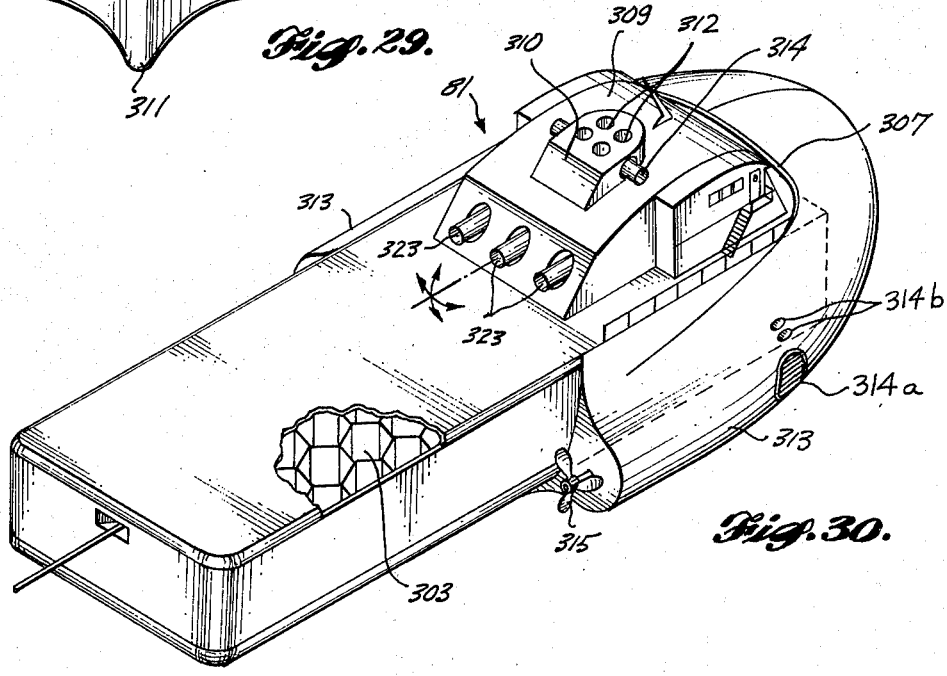
FIG. 30 is a perspective view, partially in section of the tug vessel illustrated in FIG. 28.

FIGS. 28–30 illustrate in more detail the structural nature of the tug vessel 81. The tug vessel 81 includes a honeycomb core 303 generally similar to the honeycomb cores 85 of the transport modules. The honeycomb core 303 is surrounded in the rear by a plurality of vertical panels generally similar to the vertical end panels 109 associated with the transport modules and previously described. Moreover, the sides of the rear portion of the core 303 is surrounded by a plurality of vertical side panels 107 of the type previously described. However, the upper surface of the core is formed by an upper floor and is generally planar. Further, as will be better understood from the following description, the foresection of the tug vessel includes a prow 305. Moreover, a keel 311 extends longitudinally beneath the vessel.

The prow 305 is rather blunt and diverges upwardly until it terminates at a coaming 307. The coaming 307 extends transversely and rearwardly so as to surround the front portion of a chain 309.

The cabin 309 lies atop the planar upper floor of the honeycomb core 303 immediately rearwardly of the coaming 307. The cabin 309 is adapted to provide living quarters for the vessel's personnel and an operators station that includes the normal control mechanism associated with an ocean going vessel, i.e., radar communication, navigational aids and control systems for the engines, etc.

The prow 305 when viewed from the side also diverges downwardly and rearwardly into the keel 311. As viewed in FIG. 28 the keel, near the rear of the tug vessel 81 curves upwardly.

As best seen in FIG. 30, the prow 305 also diverges outwardly on either side of the tug vessel about a pair of sponsons 313, one lying one either side of the honeycomb core 301. The sponsons terminate essentially in the amidships of the tug vessel. Extending outwardly from the rear end of each sponson, on either side of the vessel, are a pair of propellers 315, one associated with each sponson. Thus, a propeller is located on either side of the honeycomb core 303, near the center of the vessel.

Preferably one of the pair of propellers 315 is a right hand propeller and the other is a left hand propeller. During normal forward motion, the propellers are rotated in opposite directions whereby they both aid in creating forward thrust. However, due to the opposite direction of rotation, torque movements tending to divert the tug vessel in one direction or the other are eliminated. This result is achieved because one propeller's torque moment is balanced by a counter torque moment produced by the other (counterrotating) propeller. The same effect occurs in reverse when the propellers are rotating in a direction opposite to their forward rotational direction (or when the propeller pitch is changed to achieve the same effect). Differential propeller rotation is used for steering, taking into consideration the opposite propeller rotating effect discussed above.

While various types of conventional engines can be used to drive the propellers, preferably, they are powered by one or more gas turbines connected in tandem. In this regard, the LM 2500, a marine version of the jet engine that powers the Lockheed C5A Military transport, produced by the General Electric Company is suitable for use.

In addition to the jet turbine propulsion system, a jet propulsion and control system is also used by the invention. In this regard, an air intake stack 310 is located atop the cabin 309. The air intake stack 310 includes a plurality of air intake apertures 312 which direct air via suiable conduits to jet engines (not shown), and to the engines driving the propellers 315. The air exhausted by the jet engines is emitted from the tug vessel 83 via rearwardly directed exhaust nozzles 323 for propulsion and attitude control. Transverse nozzles 314 extend outwardly from the air intake stack 310, above the cabin 309, and are connected to the exhaust of engines controlling the secondary steering of the tug vessel and to other auxiliary engines. Secondary steering of the tug vessel 81 is accomplished by sucking in surrounding sea water via side inlets **314*a* located in the sponsons 313 by an engine driven pump (not shown). This water is expulsed with force by the pump through exhaust tubes 314*b* transversely extending from the sides of the tug vessel 81**.

The rearwardly directed exhaust nozzles are gimbled as illustrated by the curved arrows and extend rearwardly from the cabin 309 so as to emit their exhausts above the concrete top floor of the honeycomb core 303. The rearwardly directed exhaust nozzles control the attitude of the tug vessel by varying the direction of emitted jet exhaust.

Filling and Emptying Conduit System

One of the major difficulties of a honeycomb core vessel of the type contemplated by the invention relates to the filling and emptying of the individual cells. Obviously, if separate piping must be run to each cell from a central manifold, an excessively large and complex piping system is required. The invention, however, overcomes this difficulty by providing a unique conduit system that takes advantage of the nature of the honeycomb core. In general this system uses central cells to control the emptying and filling of adjacent cells.

FIGS. 31–34 illustrate the conduit system of the invention which comprises a main pipe 401 running longitudinally down the center of a transport module above the upper floor 87. Extending transversely outwardly from the relatively large main pipe are slightly smaller branch pipes 403. Each branch pipe 403 is positioned so as to communicate with central cells 407. In this regard, central cells are defined as those surrounded by up to six subsidiary cells. More specifically, a planar view of the hexagonal cell array reveals that, except for peripheral cells, each cell is surrounded by six other cells. In accordance with the invention, certain of the cells are chosen to be central cells 407 and in communication with the main or branch pipes 401 and 403. The central cells in turn are in communication with their surrounding or subsidiary cells 409, up to six. In a few instances a peripheral cell, such as cell 413 illustrated in FIG. 31 may not lie with in either the central or subsidiary categories of cells. Communication with such cells is via a subsidiary cell. In this manner, all cells are in communication with the main pipe 401 in one manner or another. It is pointed out here that the foregoing discussion only relates to the cells used to transport the oil products and the like. There is an addition outer peripheral row of cells which, as hereinafter described, are used to transport ballast water. It is also pointed out, and will be better understood from the following discussion, that the term communication as it relates to intercellular communication does not necessarily mean that the transported product flows through the cells in "communication." Rather it means that piping or conduit extends through such cells. Further, it is pointed out that the main cells 407 may or may not be used to transport products. If desired, only the subsidiary cells 409 (and the peripheral remote cells 413) may be so used.

Projecting downwardly from the main or branch pipes into the central cells are risers 415. The risers 415 extend to the bottom of the central cells 407. Extending radially outwardly from the lower tip of the risers are horizontal fill pipes 417. The fill pipes 417 extend through the walls of the central cell into each surrounding subsidiary cell 409. If a peripheral remote cell 413 is associated with a subsidiary cell, it is connected thereto via a secondary fill pipe 419.

In the foregoing manner, a conduit system suitable for carrying the material to be stored (e.g. oil products and the like) to and from the various transport cells is provided by the invention. A plurality of valves 421 are located at various points in the main pipe 401 and the branch pipes 403 so that the flow of the material to be transported in either direction can be selectively controlled. The valves may be manually operated or they may be electro-mechanical valves, as desired.

Since the cells are, essentially, totally enclosed, it is necessary to provide a means that allows air to enter or leave the cells, as necessary, during the filling or emptying of the cells. A second conduit system performs this function. The second conduit system comprises a relatively large manifold 423 formed of a relatively small pipe (when compared with the main and branch pipes 401 and 403) surrounding each riser 415. The manifolds 423 are connected by interconnecting pipes 425.

In addition, the manifolds each include a plurality of short downwardly projecting pipes 427, one for each associated transport cell 409 and 413 (and 407, if used). The short pipes 427 pass through suitable apertures formed in the upper floor 87 and, thus, provide communication with their associated manifolds 423. The manifolds in turn, via the interconnecting pipes 425 are connected to the atmosphere.

In many environments, such as the transportation of natural gas, it is necessary to maintain a liquid at a predetermined temperature. In the case of natural gas, a cryogenic fluid is normally utilized to refrigerate the gas during transportation. The invention provides a refrigerant conduit system for circulating such a gas through the various cells during transportation to accomplish this result.

The refrigerant conduit system comprises an inlet manifold 429 and a slightly smaller outlet manifold 430 concentrically located about each riser 415. Inlet interconnecting pipes 433 connect the inlet manifolds together and outlet interconnecting pipes 435 connect the outlet manifolds together. Cooling pipes having good thermal conducting properties zig-zag about the walls of each transport cell. One end of the cooling pipe associated with each such cell is attached to the inlet manifold 429 and the other end is attached to the outlet manifold 430.

In operation, a cold refrigerant fluid is conducted to each inlet manifold via the inlet interconnecting pipes. The refrigerant or cryogenic fluid flows into each individual cell, through the zig-zag pipes located about the walls of the cells, and exits via the outlet manifold 430. In this manner, a suitable cooling fluid is circulated through each cell and maintains the temperature of the liquid gas stored therein at a predetermined level. Since the inlet and outlet manifolds are all interconnected, a common gas reservoir and pumping system can be utilized.

Figure 36:
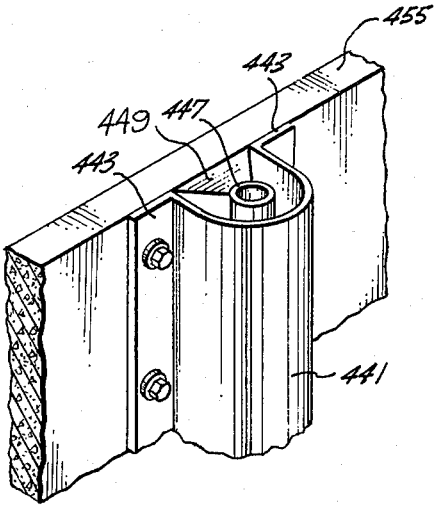
FIG. 36 is a partial perspective view illustrating a mechanism for protecting steel pipes from the effects of crude oil sludge acids.

Preferably, the zig-zag piping that carries the cryogenic fluid through the cells is formed of a material which will not be attacked natural gasses, or other liquids being transported. If, however, for one reason or another, this pipe must be formed of a material which will be so attached, the invention provides a housing suitable for protecting the pipe from such an attack. FIG. 36 illustrates the housing. The housing comprises a U-shaped element 441 having a pair of outwardly extending flanges 443. The flanges are attached to the adjacent wall 445 of the cell so as to surround the pipe 447 carrying the cryogenic fluid. An insulative support 449 extending out from the adjacent cell wall 445 supports the pipe inside of the housing 441.

The efficient transportation of natural gas requires the liquification of the gas through the combination of cooling, described above, and the application of pressure. The invention creates the required pressure by attaching the air conduit system to a suitable pressure pump.

Ballast Conduit System

As indicated above, the peripheral row of cells are not intended for use in transporting the products to be transported. Rather, these cells are used to transport or carry ballast water, when necessary. Because these cells are selectively filled and emptied a ballast conduit system separate from the emptying and filling conduit system is necessary.

Figure 31:
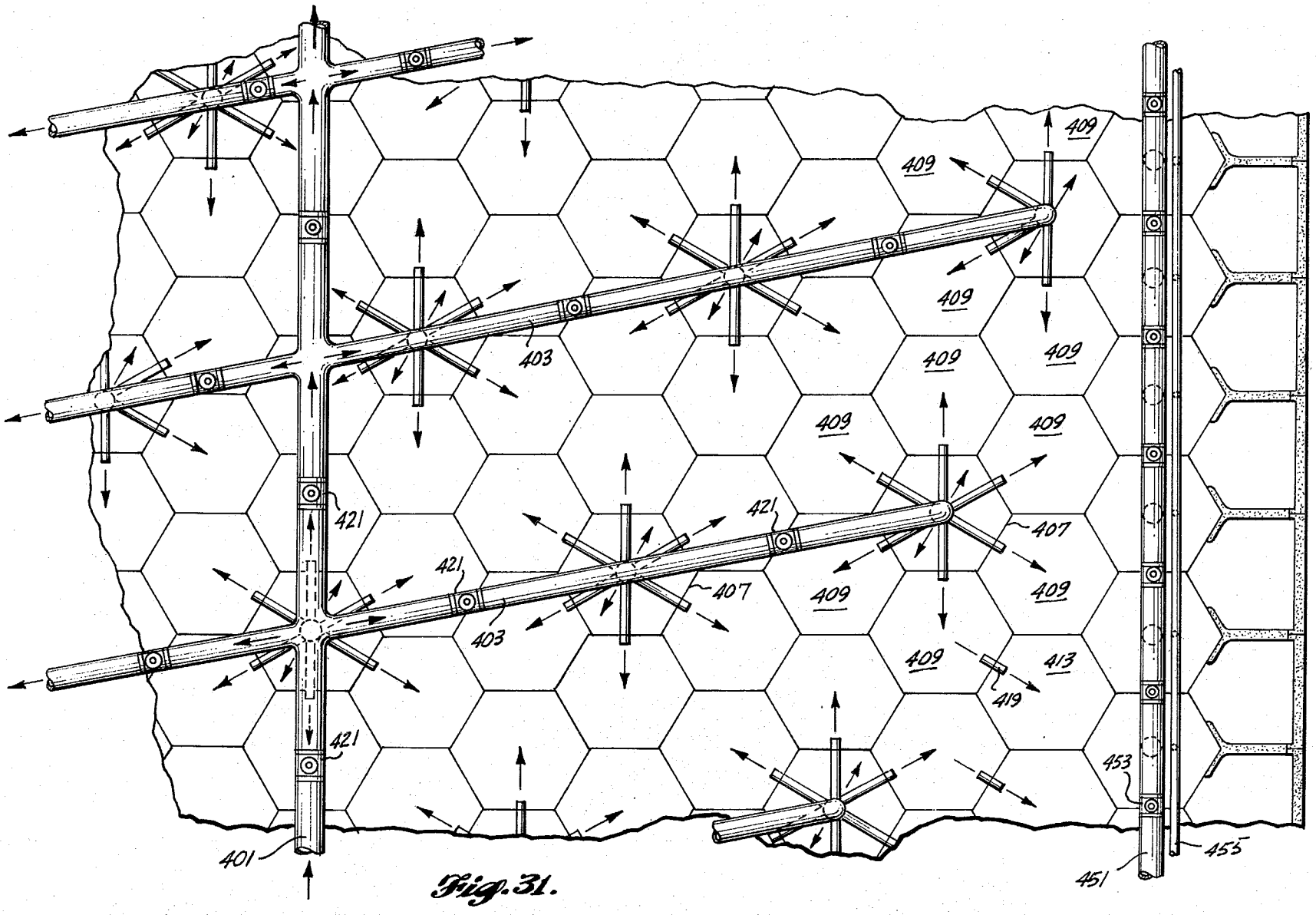
FIG. 31 is a top view illustrating a cell filling and emptying conduit array formed in accordance with the invention.
Figure 32:
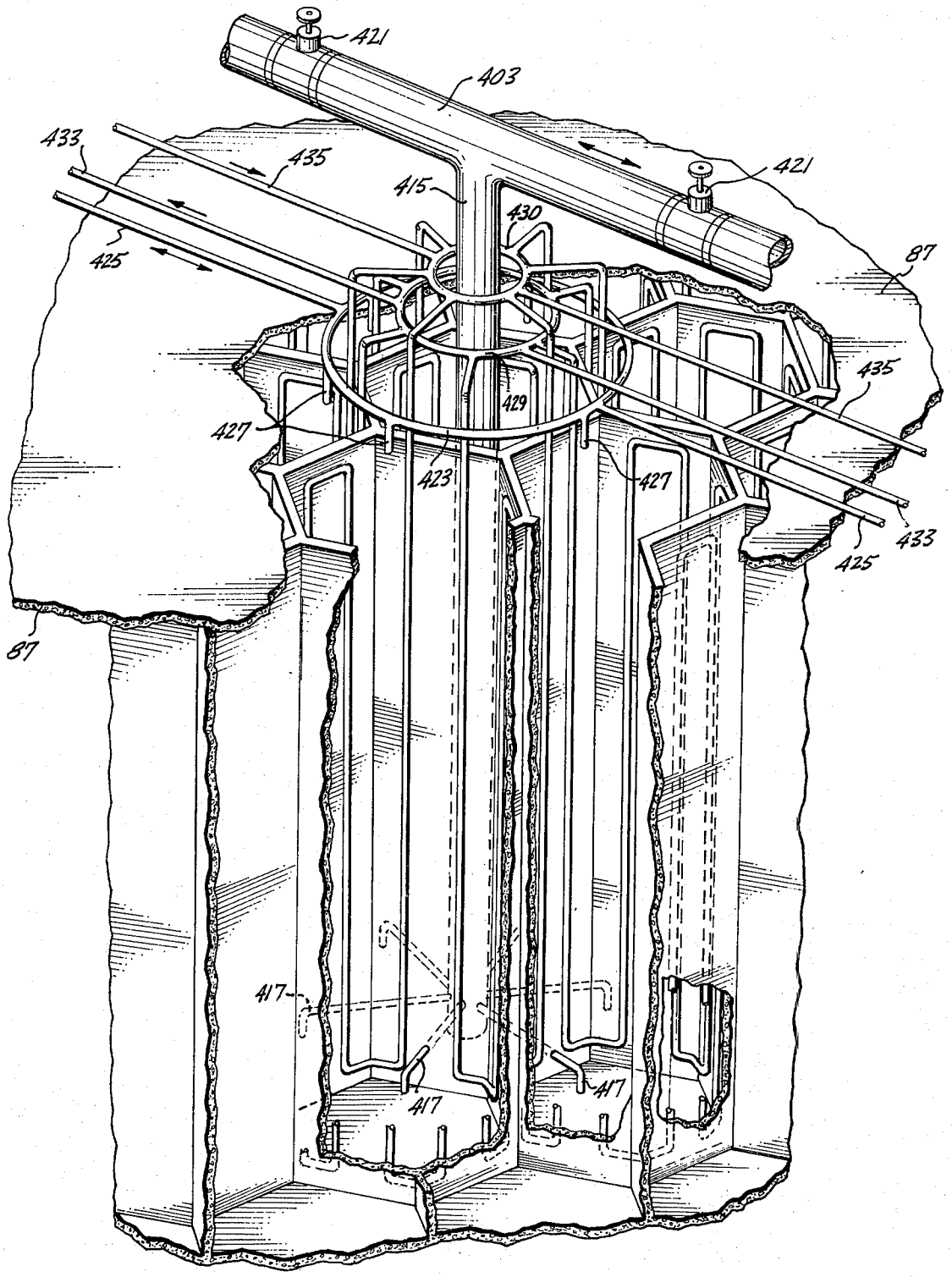
FIG. 32 is a perspective view, partially in section, illustrating a portion of the cell filling and emptying conduit array of the invention.
Figure 35:
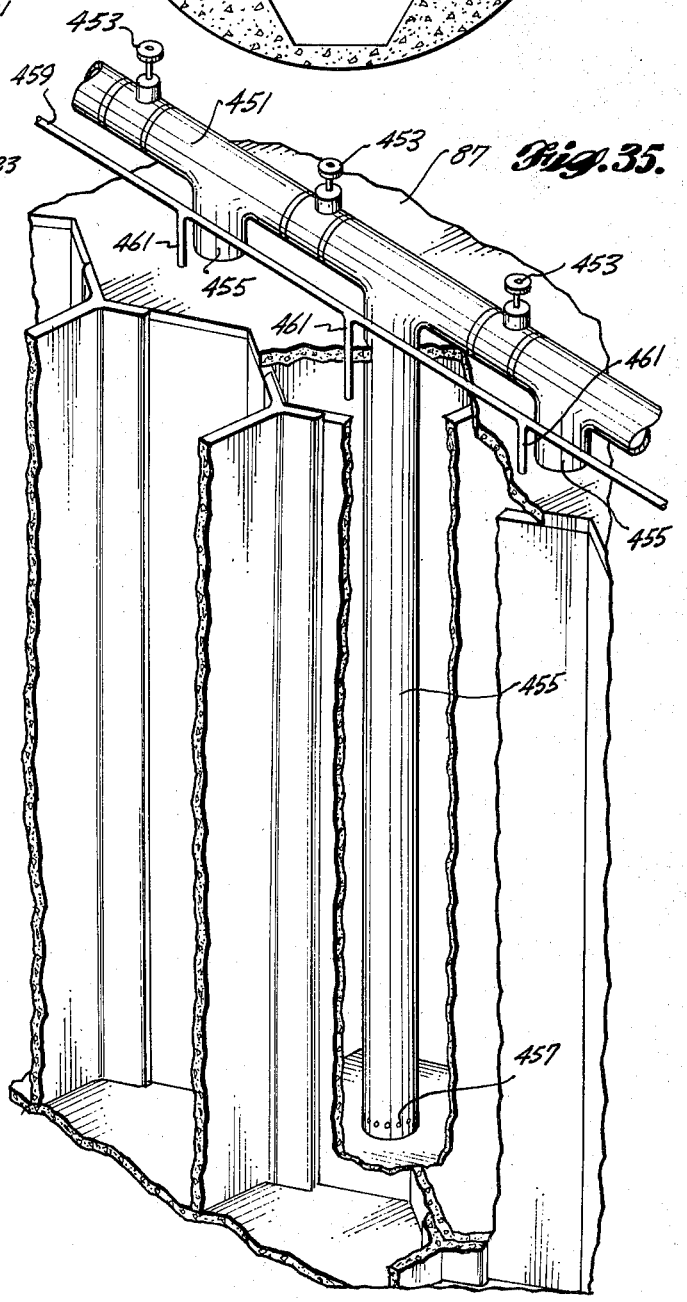
FIG. 35 is a perspective view, partially in section, illustrating a conduit arrangement for filling and emptying ballast cells.

FIGS. 31 and 35 illustrate a suitable ballast conduit system comprising a primary pipe 451 running along the upper floor 87, above the outer row of cells. Located at predetermined intervals along the primary pipe 451 are a series of control valves 453. Projecting downwardly from the primary pipe 451 into each cell of the row of cells is a ballast riser 455. The ballast risers 455 extend to the bottom of their associated cells. A plurality of apertures 457 are circumferentially located near the lower end of each ballast riser. Ballast water flows through the primary pipe and the ballast risers, and enters or leaves the cells via the apertures 457. In addition, an air line 459 runs along the upper floor 87 in parallel with the primary pipe 451. The air line includes a plurality of air risers 461, one projecting into each peripheral row cell. The air line allows air to flow into or out of the associated cells, as ballast water is added to or removed from these cells.

Obviously, in some instances, it may be desirable to have larger ballast water capacity than that provided by a single row of cells, so as to create a low center of gravity, for example. In accordance with the invention this result is accomplished by using the space between the honeycomb core 85 and the side (and end) panels 107, as well as the space between the lower floor 89 and the bottom to carry additional ballast water. In this regard, the "ballast row" of cells will contain apertures allowing water (and air) communication between these cells and the foregoing spaces. Further, suitable risers (not shown) will be provided to allow water and air communication to the space between the lower floor and the bottom. For example, some of the ballast risers 455 can be extended into this region. If desired, the cells associated with these extended risers can be left empty.

Transportation Vessel Summary

In summary, the invention provides a novel transportation vessel or boat formed primarily of concrete. The overall vessel comprises a chain of transport modules and a tug vessel, each housing a honeycomb core comprising a series of cells having hexagonal cross-sectional shapes. The module cores are surrounded by concrete panels which form an outer hull configuration that allows the modules to easily move through the water. A universal joint mechanism allows each module to move independently of the other modules contained in the chain. Thus, wave forces are dissipated in a manner not entirely dependant on structural strength, whereby hull strength per se can be reduced. A novel emptying and filling conduit system allows transportation cells to be readily filled or emptied. Moreover, because ballast cells are maintained separated from transportation cells, ballast water does not become contaminated by transported products. Hence, ballast water does not have to be filtered prior to its being returned to the sea.

Because the cells are mainly formed of concrete, they are not as readily destroyed by crude oil sludge acids and the like as they would be if the cells were formed of iron or other, more readily destroyed, materials. Also, because the basic structure is cellular in nature, the destruction of one or more cells will not result in the overall module or vessel sinking. Further, the total destruction of a single transportation cell or a few such cells will only disgorge the products contained in those cells. The oil products contained in undamaged cells will remain in those cells. Hence, the amount of oil spillage caused by collision or running aground will be relatively small. In this regard, it should be noted that ballast control can be used to lower the modules and prevent leakage from the bottom of one or more cells should be destroyed bottom situation occur.

Because a modular type of transportation vessel is provided by the invention, individual modules can be readily moved from an off-shore location to an oil depot. In this regard, a suitable tug vessel stationed at the depot can two a single module, or several modules, from an offshore location into a harbor. The remaining modules can then proceed to a location offshore of a second oil depot. It will be appreciated that the nature of the invention is such that individual modules do not draw as much water as does a large tanker or supertanker. Hence, the modules can be brought into shallower harbors than can such tankers.

CONCRETE BUOYS

Figure 37:
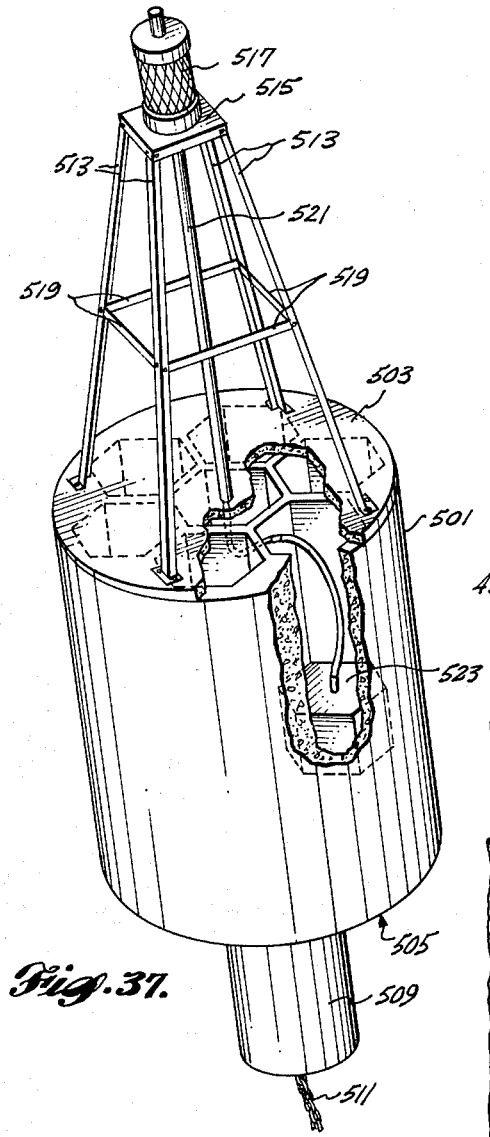
FIG. 37 is a perspective view, partially in section, of a buoy formed in accordance with the invention.
Figure 38:
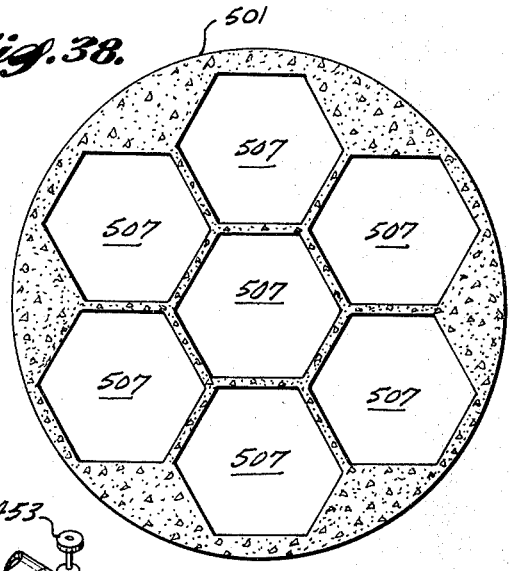
FIG. 38 is a transverse cross-sectional view of the buoy illustrated in FIG. 37.

As discussed above, the basic core structure of the invention is not only suitable for forming transportation vessels, but also can be utilized to create platforms, buoys and the like. FIGS. 37 and 38 illustrate a concrete buoy formed in accordance with the invention. The buoy illustrated in FIGS. 37 and 38 is basically a drum shaped structure, i.e., it has a cylindrical outer periphery 501 and top and bottom walls 503 and 505. The inner structure of the drum is honeycombed, i.e., it is formed of a plurality of hexagonal cells 507. The hexagonal cells 507 are illustrated as seven in number; a central hexagonal cell surrounded by six hexagonal cells. However, it will be appreciated that various other numbers of cells could be utilized, as desired. The enclosing top and bottom walls prevent water from entering the hexagonal cells when the buoy is immersed in the water.

Structurally, the hexagonal cells may be first formed individually and then joined in the manner illustrated in FIG. 1 and hereinabove described. Alternatively, a unitary structure housing the desired hexagonal cell array can be simultaneously formed.

As illustrated in FIG. 37 a connecting lug 509 projects downwardly from the bottom surface of the drum and is connected to a chain 511 running to a suitable anchor. Converging upwardly from the upper plate 503 are four legs arrayed so as to define a truncated pyramid.

A plurality of braces 519 running between adjacent legs adds support to the pyramid. The pyramid platform supports a light 517. Extending downwardly through the center of the pyramid is an electrical conduit 521 which conveys an electrical wire from the light 517 to a source of power 523 located in one of the hexagonal cells 507.

It will be appreciated that, because of the desirability of utilizing concrete in water, the life of a buoy formed in the manner illustrated in FIGS. 37 and 38 described above is preferred over buoys formed of iron and the like.

It should be noted that the buoy silhouette illustrated in FIG. 37 and 38 is merely illustrative and that other types of buoy configurations, well known to boat pilots, can be formed utilizing the basic concept of the invention. That is, the shapes of buoys define certain navigational information to pilots. Concrete buoys having any desired shape can be formed utilizing the invention.

FLOATING PLATFORMS

As also indicated above, the invention also includes creating floating platforms as well as buoys and liquid transportation vessels. FIGS. 39–47 illustrate a floating dock 601 formed in accordance with this aspect of the invention. It will be appreciated, however, that other types of floating platforms which may or may not be anchored and which may be located well remote from a shoreline, i.e., in the deep portions of the oceans, can be formed utilizing the same general concepts illustrated in these figures, and described below.

Figures 39, 40:
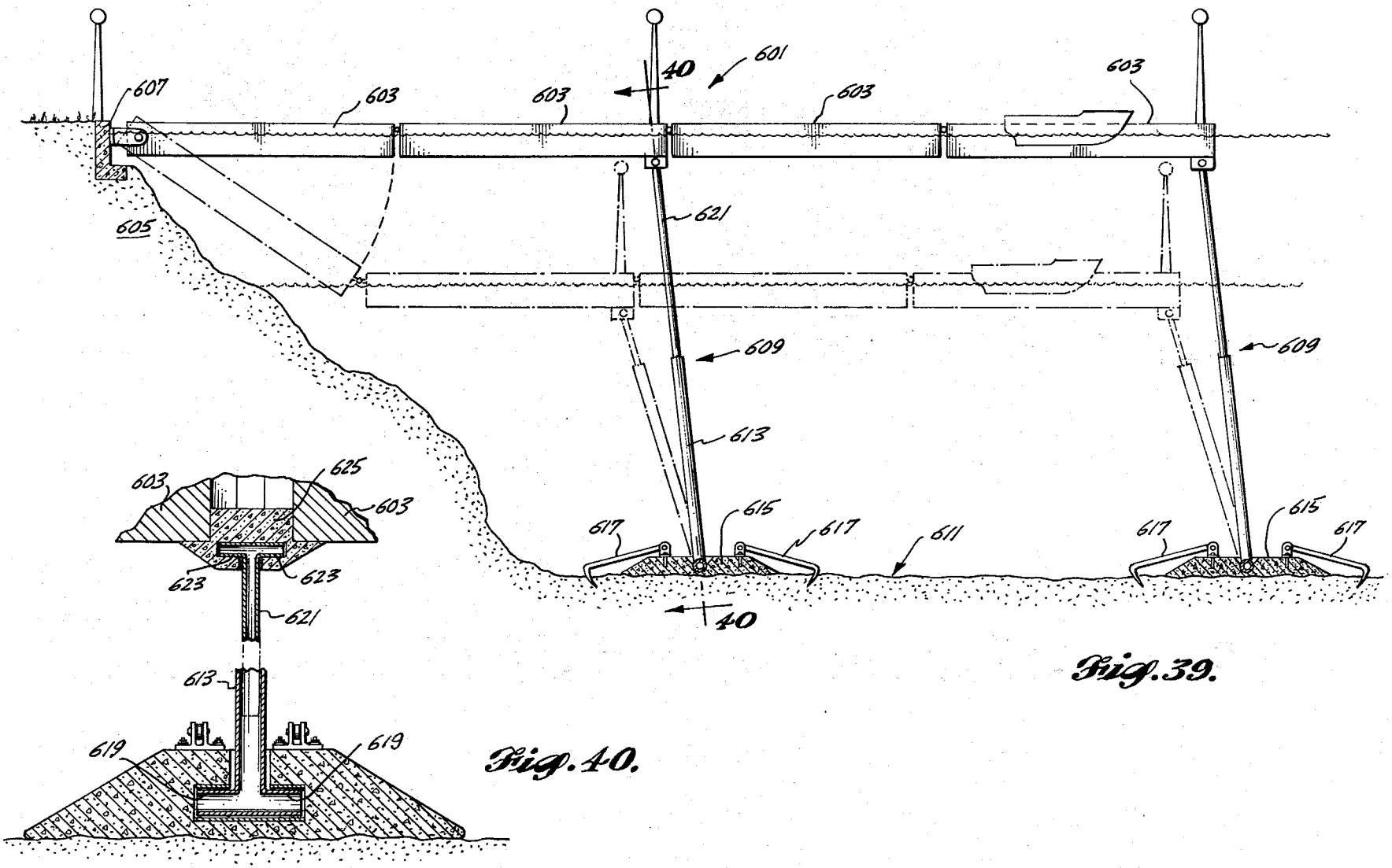
FIG. 39 is a side elevation of a dock formed in accordance with the invention.
FIG. 40 is a cross-sectional view of an anchoring mechanism formed in accordance with the invention for anchoring a dock of the type illustrated in FIG. 39.

The dock 601 illustrated in FIG. 39 comprises four sections 603; however, a greater or lesser number of sections can be included as desired. The sections 603 extend outwardly, end-to-end, in a string from the shore 605. The shoreward section is hinged to a concrete base 607 permanently mounted on the shore 605. The hinge axis is such that the shoreward section can rotate in a vertical plane as the tide rises and falls (or the water level changes for some other reason, as illustrated by the dot-dash lines of FIG. 39). Thus, the shoreward section moves between a horizontal position and inclined positions.

Lateral movement of the dock sections 603, without restraining the upward or downward movement thereof is prevented by connecting mechanisms 609. The connecting mechanisms 609 connect a predetermined number of dock sections 603 to the ocean, river or lake floor 611.

Each connecting mechanism 609 comprises a lower inverted T-shaped member 613. The arms 619 or the inverted T-shaped member 613 are imbedded in a concrete block 615 anchored by suitable anchor elements 617 to the floor 611. The formation and anchoring is such that the arms of the inverted T-shaped member 613 can rotate about the axis lying generally orthogonal to the longitudinal axis defined by the dock 601. Each connecting mechanism 609 also comprises an upper upright T-shaped member 621 affixed in a somewhat similar manner to a dock section.

The upright T-shaped member 621 includes a downwardly projecting leg slidably mounted in the upwardly projecting leg of the inverted T-shaped member 613. In addition, the arms 623 of the upright T-shaped member 621 are rotatably mounted in a suitable support block 625 affixed to the dock section 603. The axis of rotation is again orthogonal to the longitudinal axis of the dock 601.

It will be appreciated that the connecting mechanism allows the dock sections 603 to move upwardly and downwardly with changes in water level, while preventing lateral movement of the dock 601. This action is allowed because the T-shaped sections are free to rotate and move with respect to one another.

Figure 41:
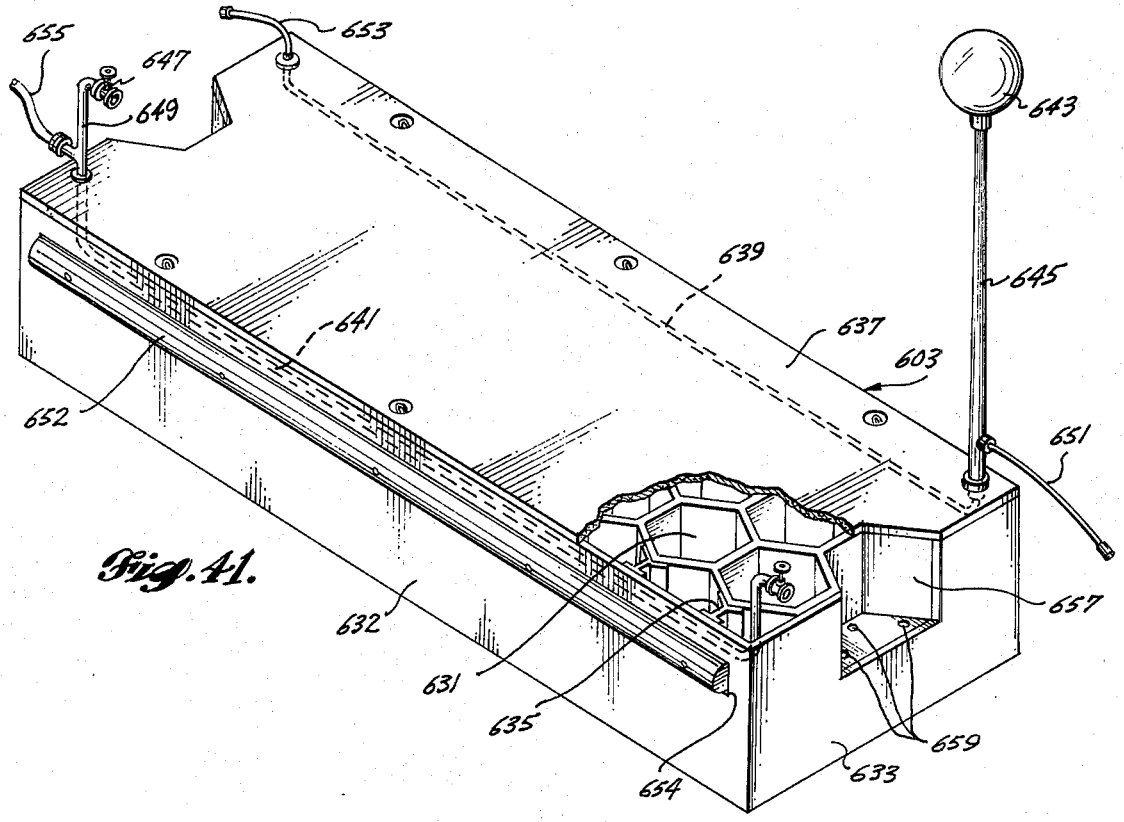
FIG. 41 is a perspective view of a dock segment formed in accordance with the invention.

FIG. 41 illustrates in detail a dock section 603. The dock section comprises a honeycomb core 631 formed of a plurality of hexagonal cells formed and arrayed in the manner previously described. That is, the cells are individually formed and arrayed in a predetermined spaced manner. Thereafter, concrete is injected between the cells so as to create a unitary structure.

Surrounding the core 631 are side panels 632 and end panels 633. The side panels are attached to the core 631 by a series of vertical ribs 635. A bottom (not viewable) and a top 637 enclose the tops and bottoms of the cells. In this manner, a watertight cellular structure is formed. The cells provide the buoyancy necessary for the dock section to float.

As illustrated in FIG. 41, electrical conduits 639 and water conduits 641 can be housed in the dock section 603 to provide paths for power and water beneath the surface of the top 637. A lamp 643 mounted on an electrical riser 645 is coupled to the electrical conduit; and, a faucet 647 mounted on a water riser 649 is connected to the water conduit 641. The dock sections are interconnected electrically by flexible electrical jumpers 651 and 653. In addition, water conduit coupling is provided by flexible water coupling conduits 655. Further, elongated cushions 652 are held in horizontal slots 654 running substantially the entire length of the side panels 632.

The dock section 603 may be coupled together so as to be movable upwardly and downwardly or back and forth; or they may be fixed (immovable) with respect to one another. In this regard, located at either end of each dock section is an open topped aperture 657. When viewed from above, the aperture is in the form of a truncated pyramid that forms essentially one-half of a hexagon and is also open at its base to the associated end of the dock section. The depth of the aperture 657 may vary and is illustrated as substantially one-half the depth of the dock section. Located at the bottom of the aperture 657 is an array of three holes 659 housing nuts adapted to receive bolts.

Figure 42:
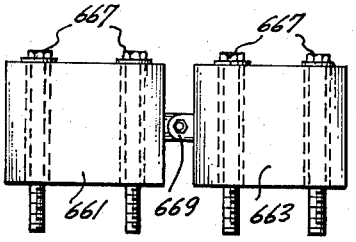
FIG. 42 is a side view of one form of coupling mechanism suitable for coupling together dock segments of the type illustrated in FIG. 41.
Figure 43:
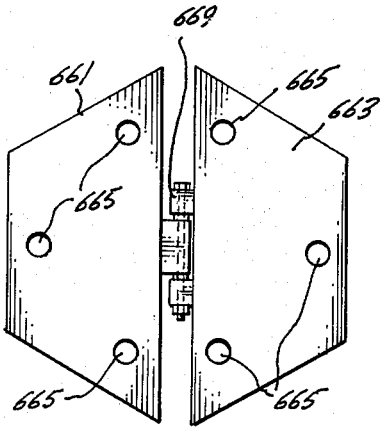
FIG. 43 is a top view of the coupling mechanism illustrated in FIG. 42.

FIGS. 42–47 illustrate various connectors that are mountable in the aperture 657 and suitable for connecting a pair of dock sections together so that they are movable in any one of the manners previously described. Specifically, FIGS. 42 and 43 illustrate an interconnection mechanism which includes two connector sections 661 and 663. Each connector section is in the form of a truncated pyramid, when viewed in a particular plane. Each connector section is sized so as to fit into a dock section end aperture 657. Each connector section includes bolt holes 665 adapted to align with the nut holes 659 when a connector section lies in a dock section end aperture 657. Bolts 667 are adapted to pass through the apertures in the connector section 663 and 661 thread into the nuts held in the apertures 659 located at the bottom of the dock section end apertures 657. The facing surfaces of the two connector sections 661 and 663 are hinged together by a hinge mechanism 669 which allows the sections to move with respect to one another. The hinge axis is essentially horizontal when the connector sections are attached to a pair of adjacent dock sections in the manner previously described.

Figure 44:
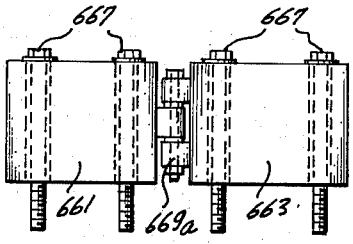
FIG. 44 is a side view of a second form of coupling mechanism suitable for coupling together dock segments of the type illustrated in FIG. 41.
Figure 46:
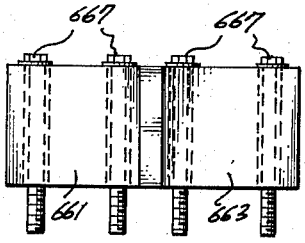
FIG. 46 is a side view of a third form of coupling mechanism suitable for coupling together dock segments of the type illustrated in FIG. 41; and, FIG. 47 is a top view of the coupling mechanism illustrated in FIG. 46.
Figure 45:
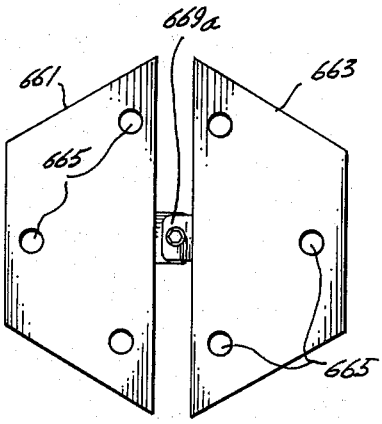
FIG. 45 is a top view of the coupling mechanism illustrated in FIG. 44.
Figure 47:
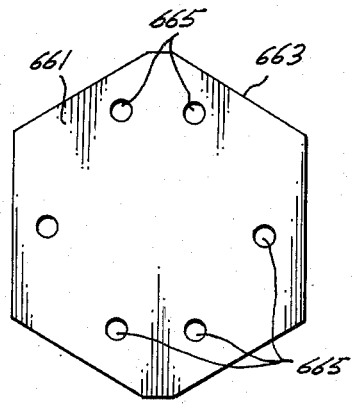

FIGS. 44 and 45 illustrate essentially an identical connector structure to that illustrated in FIGS. 42 and 43 except that the hinge axis is vertical. FIGS. 46 and 47 illustrate a further connector structure which is unhinged, i.e., the two connector sections 661 and 663 are contiguously formed. Since the connectors illustrated in FIGS. 44–47 are essentially identical to the structures illustrated in FIGS. 42 and 43, they will not be further described.

CONCLUSION

It will be appreciated that the herein described invention is suitable for widespread use in various environments. These environments include those related to the transportation of liquids and the like and those related to floating platforms and the like. While the invention has been illustrated as formed of independent cellular members connected together, it may be desirable to create a plurality of such sections in an assembly and couple the assemblies together. Alternatively, in some environments, it may be desirable to preform the entire core assembly. However, in relatively large structures, the illustrated matter of formation will obviously be preferred. Thus, while preferred embodiments of the invention have been illustrated and described, it will be appreciated that the invention can be practiced otherwise than as specifically described therein.

The embodiments of the invention in which an exclusive property or privilege is claimed are defined as follows:

What is claimed is:

1. A concrete dock, said concrete dock comprising:

1. a plurality of sections, each of said sections comprising:
   a. a honeycomb core having a top, a bottom, generally parallel sides and generally parallel ends, said honeycomb core defining a plurality of elongate hexagonal cells, said elongate hexagonal cells being separated by walls formed essentially entirely of reinforced concrete;
   b. a bottom formed essentially entirely of reinforced concrete surrounding said bottom of said honeycomb core;
   c. a top formed essentially entirely of reinforced concrete surrounding the top of said honeycomb core;
   d. sidewalls formed essentially entirely of reinforced concrete surrounding the sides of said honeycomb core;
   e. endwalls formed essentially entirely of reinforced concrete surrounding the ends of said honeycomb core; said bottom, top, side and end walls being connected together and to said honeycomb core in a manner such that said honeycomb core is entirely enclosed thereby;
2. connecting means for connecting said plurality of sections together in a predetermined manner; and,
3. at least one telescoping anchoring means for anchoring said dock sections to the floor of a body of water, said telescoping anchoring means comprising a first T-shaped section having its T end rotatably anchored to the bottom of said body of water and a second T-shaped section having its leg telescopingly connected to the leg of said first T-shaped section and its T end rotatably connected to one of said plurality of sections.

2. A floating concrete dock as claimed in claim 1 including electrical conduit means formed in at least some of said dock sections for conveying electrical power through said dock sections and fluid conduit means formed in at least some of said dock sections for conveying water through said dock sections.

3. An ocean transport vessel suitable for transporting oil products and the like, said transport vessel comprising:

1. a tug vessel suitable for towing a plurality of transport modules connected in a chain;
2. a plurality of transport modules, each of said transport modules including:
   a. a honeycomb core comprising a plurality of elongate cells, each having a hexagonal cross-section, arrayed in a uniform manner such that each cell defines an enclosure that is independent of each and every other cell, said cells defined by unitary walls;

b. a hull comprising at least a bottom and sidewalls, said bottom and sidewalls formed of a plurality of reinforced precast concrete panels;

c. hull expansion joints located between the plurality of reinforced precast concrete panels forming said bottom and sidewalls; and, d. mounting means for mounting said honeycomb core in said hull, said mounting means mounting said honeycomb core in spaced relationship with respect to said bottom and sidewalls of said hull in a manner such that an enclosure suitable for transporting ballast water is formed between said honeycomb core, said bottom and sidewalls, said mounting means including core expansion joints located between said honeycomb core and said bottom and sidewalls of said hull; and, 3. connecting means for connecting said transport modules together and to said tug vessel in a chain, said connecting means connecting said transport modules and said tug vessels in a semi-rigid manner that allows said transport modules and said tug vessels to move essentially independently of one another while maintaining a minimum spaced distance between adjacent ones of said transport modules and said tug vessel, said connecting means comprising a universal joint located at opposing ends of each module, a telescoping tube projecting outwardly from each universal joint and coupling means located at the outer end of each telescoping tube for coupling together adjacent telescoping tubes projecting outwardly from adjacent ones of said transport modules and said tug vessel.

4. A transport vessel as claimed in claim 3 wherein said universal joints comprise:

a concrete block mounted in an aperture in the ends of said transport module and said tug vessel for rotation about a vertical axis;

a T-shaped element mounted in said concrete block for rotation about a horizontal axis; and, a hydraulic fluid conduit running through said concrete block and said T-shaped element so as to be able to follow the movement of said T-shaped element.

5. A transport vessel as claimed in claim 4 wherein said coupling means includes: connecting shafts linked to associated T-shaped elements; and, a connecting mechanism comprising a male element and a female element and hydraulic connectors connected to said hydraulic fluid conduit.

6. An ocean transport vessel as claimed in claim 3 wherein:

the walls of said cells forming said honeycomb core are essentially entirely formed of reinforced concrete; and, said bottom and sidewalls of said hull are formed of reinforced concrete panels.

7. A transport vessel as claimed in claim 6, wherein each of said cells defines an elongated cylinder having a hexagonal cross-section.

8. A transport vessel as claimed in claim 7 wherein said cells are arrayed in a plurality of superimposed layers, and wherein the ends of said cells are formed in a manner such that cells in one layer are adapted to interconnect with juxtaposed cells in an adjacent layer.

9. A transport vessel as claimed in claim 8 wherein said hexagonal cells are essentially vertically arrayed and said honeycomb core defines generally planar upper and lower surfaces and wherein said transport modules include an upper floor enclosing said generally planar upper surface of their associated honeycomb cores and a lower floor enclosing said generally planar lower surface of their associated honeycomb cores.

10. A transport vessel as claimed in claim 6 wherein each of said transport modules include an emptying and filling conduit system suitable for emptying and filling selected ones of said cells forming said honeycomb core.

11. A transport vessel as claimed in claim 10 wherein each of said emptying and filling conduit systems comprise:

a main pipe located above the honeycomb core of the associated transport module;

a plurality of branch pipes extending transversely from said main pipe above the honeycomb core of said associated transport module and connected to said main pipe; and, a plurality of riser pipes selectively running from said main and said branch pipes to selected ones of said cells forming said honeycomb core of said associated transport module.

12. A transport vessel as claimed in claim 11 wherein each transport module includes a ballast water conduit system connected to the peripheral row of cells of the honeycomb core associated with a particular transport module for emptying and filling said peripheral row of cells with ballast water, said ballast water conduit system being entirely separate from said emptying and filling conduit system associated with a particular transport module.

13. A transport vessel as claimed in claim 11 wherein said selected cells are central cells, said central cells being surrounded by subsidiary cells, and wherein said emptying and filling conduit system comprises a plurality of pipes communicating between said central cells and their associated subsidiary cells.

14. A transport vessel as claimed in claim 13 wherein said emptying and filling conduit systems also include vent piping systems for allowing air to enter and leave selected ones of said cells as said selected ones of said cells are emptied and filled with a material to be transported in said cells.

15. A transport vessel as claimed in claim 14 including a refrigerant piping system adapted to selectively pass refrigerant through selected ones of said cells to cool the interior thereof.

16. A transport vessel as claimed in claim 9 wherein:

1. said hull comprising at least a bottom and sidewalls includes:

a. a bottom formed of a plurality of precast concrete panels;

b. a pair of opposing sidewalls each formed of a plurality of reinforced precast concrete panels;

c. a pair of opposing end walls each formed of a plurality of reinforced precast concrete panels; and, d. a roof formed of a plurality of reinforced precast concrete panels; and 2. said mounting means comprises;

a. spacing means for supporting said lower floor above said bottom;

b. side attachment means for attaching said pair of opposing sidewalls to said honeycomb core array;

c. end attachment means for attaching said pair of opposing end walls to said honeycomb core array in a manner such that said pair of opposing end walls lie generally transverse to said pair of opposing sidewalls; and, d. roof support means for supporting said roof above said upper floor.

17. An ocean transport vessel suitable for transporting oil products and the like, said transport vessel comprising:

1. a tug vessel suitable for towing a plurality of transport modules connected in a chain, said tug vessel including:
   a. a honeycomb core array defining a plurality of hexagonal cells separated by walls formed essentially entirely of concrete;
   b. sponsons located on either side of said honeycomb core, said sponsons terminating amidships of said honeycomb core; and,
   c. driving means extending rearwardly from the rear end of each sponson, said driving means including propellers adapted to rotate in opposite directions;
2. a plurality of transport modules, each of said modules including a honeycomb core comprising a plurality of cells arrayed in a manner such that each cell is independent of each and every other cell, said cells being defined by unitary walls essentially entirely formed of reinforced concrete; and,
3. connecting means for connecting said transport modules together and to said tug vessel in a chain, said connecting means allowing said transport modules and said tug vessel to move essentially independently of one another.

18. A transport vessel as claimed in claim 17 wherein said tug vessel also includes jet exhaust means for controlling the attitude of said tug vessel.

19. A concrete floating structure comprising:

a plurality of elongate cells, each of said cells having a hexagonal cross-sectional shape, the walls of said cells being essentially entirely formed of reinforced concrete;

orienting, spacing and attaching means for attaching said cells to one another in spaced relationship so as to form a honeycomb of spaced cells;

concrete located in the space between said cells so as to attach adjacent cells together such that a structurally uninterrupted lightweight reinforced concrete honeycomb core is formed; and, a housing surrounding said structurally uninterrupted lightweight reinforced concrete honeycomb core, said housing formed of precast concrete panels connected together and to said structurally uninterrupted lightweight reinforced concrete honeycomb core by expansion joints that allow a predetermined amount of housing deformation to occur without cracking and breaking of either the precast concrete panels forming said housing or said structurally uninterrupted lightweight reinforced concrete honeycomb core.

20. A concrete floating structure as claimed in claim 19 wherein said cells are arrayed in a plurality of superimposed layers, and wherein the ends of said cells are formed in a manner such that cells in one layer are adapted to interconnect with juxtaposed cells in an adjacent layer.

21. A transport module comprising:

a honeycomb core comprising a plurality of elongate cells having a hexagonal cross-section arrayed in a uniform manner such that each cell defines an enclosure that is independent of each and every other cell, said cells being defined by unitary walls;

a hull formed of a plurality of reinforced precast concrete panels;

hull expansion joints located between the plurality of reinforced precast concrete panels forming said hull;

mounting means for mounting said honeycomb core in said hull in spaced relationship with respect to said hull in a manner such that an enclosure suitable for transporting ballast water is formed between said honeycomb core, and said hull, said mounting means including core expansion joints located between said honeycomb core and said hull; and, connecting means for connecting said transport module to other transport modules in a manner that allows said transport module to move essentially independently of other transport modules while maintaining a spaced distance between said transport module and adjacent transport modules, said connecting means comprising first and second universal joints located at opposing ends of said transport module, first and second telescoping tubes projecting outwardly, respectively, from said first and second universal joints, and first and second coupling means located, respectively, at the outer end of said first and second telescoping tubes and adapted to rigidly couple the outer ends of the telescoping tubes of said transport module with the outer ends of the telescoping tubes of other transport modules.

22. A transport module as claimed in claim 21 wherein said cells are arrayed in a plurality of superimposed layers, and wherein the ends of said cells are formed in a manner such that cells in one layer are adapted to interconnect with juxtaposed cells in an adjacent layer.

23. A transport module as claimed in claim 21 wherein said hexagonal cells are generally vertically arrayed and wherein said honeycomb core defines generally planar upper and lower surfaces; and, including a lower floor enclosing said generally lower planar surface and an upper floor enclosing said generally planar upper surface.

24. A transport module as claimed in claim 23 wherein:

1. said hull includes:
   a. a bottom formed of a plurality of precast reinforced concrete panels;
   b. a pair of opposing side walls each formed of a plurality of reinforced concrete panels;
   c. a pair of opposing end walls each formed of a plurality of reinforced precast concrete panels; and,
   d. a roof formed of a plurality of reinforced precast concrete panels; and,
2. said mounting means includes:
   a. spacing means for supporting said lower floor above said bottom;
   b. side attachment means for attaching said side walls to said honeycomb core;
   c. end attachment means for attaching said end walls to said honeycomb core in a manner such that said end walls lie transverse to said side walls; and,
   d. roof support means for supporting said roof above said upper floor.

25. A transport module as claimed in claim 24 including an emptying and filling conduit system suitable for emptying and filling selected ones of said cells forming said honeycomb core.

26. A transport module as claimed in claim 25 wherein said emptying and filling conduit system comprises:

a main pipe located above said honeycomb core;

a plurality of branch pipes extending transversely from said main pipe above said honeycomb core and connected to said main pipe; and, a plurality of riser pipes running from said main and said branch pipes to selected ones of said cells forming said honeycomb core.

27. A transport module as claimed in claim 26 including a ballast water conduit system connected to the peripheral row of cells of said honeycomb core for emptying and filling said peripheral row of cells with ballast water, said ballast water conduit system being entirely separate from said emptying and filling conduit system.

28. A transport module as claimed in claim 27 wherein said emptying and filling conduit systems also include vent piping systems for allowing air to enter and leave said cells as said cells are emptied and filled with a material to be transported in said cells.

29. A transport module as claimed in claim 28 including a refrigerant piping system adapted to selectively pass refrigerant through selected ones of said cells to cool the interior thereof.

* * * * *